US007195334B2

(12) United States Patent
Nakamura

(10) Patent No.: US 7,195,334 B2
(45) Date of Patent: Mar. 27, 2007

(54) HEAD CAP; LIQUID DROPLET EJECTION APPARATUS PROVIDED WITH HEAD CAP; METHOD OF MANUFACTURING LCD DEVICE, ORGANIC EL DEVICE; ELECTRON EMISSION DEVICE, PDP DEVICE, ELECTROPHORETIC DISPLAY DEVICE, COLOR FILTER, AND ORGANIC EL; METHOD OF FORMING SPACER, METALLIC WIRING, LENS, RESIST, AND LIGHT DIFFUSION BODY

(75) Inventor: Shinichi Nakamura, Okaya (JP)

(73) Assignee: Seiko Epson Corporation (JP)

( * ) Notice: Subject to any disclaimer, the term of this patent is extended or adjusted under 35 U.S.C. 154(b) by 609 days.

(21) Appl. No.: 10/647,893

(22) Filed: Aug. 25, 2003

(65) Prior Publication Data

US 2004/0119776 A1 Jun. 24, 2004

(30) Foreign Application Priority Data

Aug. 26, 2002 (JP) ..... 2002-245476
Jul. 3, 2003 (JP) ..... 2003-190815

(51) Int. Cl.
*B41J 2/165* (2006.01)

(52) U.S. Cl. ..... 347/29; 347/30

(58) Field of Classification Search ..... 347/22, 347/24, 29, 30, 31, 32, 33
See application file for complete search history.

(56) References Cited

U.S. PATENT DOCUMENTS 6,364,449 B1 * 4/2002 Takahashi et al. ..... 347/30
6,481,822 B2 * 11/2002 Murcia et al. ..... 347/22

FOREIGN PATENT DOCUMENTS

| | | |
|---|---|---|
| JP | 07-290723 | 11/1995 |
| JP | 11-268299 | 5/1999 |
| JP | 2000-062202 | 2/2000 |
| JP | 2000-103072 | 4/2000 |
| JP | 2001-322296 | 11/2001 |

OTHER PUBLICATIONS

Communication from Japanese Patent Office re: counterpart application.
Communication from Korean Patent Office regarding counterpart application.

* cited by examiner

*Primary Examiner*—Shih-Wen Hsieh
(74) *Attorney, Agent, or Firm*—Harness, Dickey & Pierce, P.L.C.

(57) ABSTRACT

A head cap which comes into close contact with a nozzle surface of a function liquid droplet ejection head to thereby seal the function liquid droplet ejection head has a cap base; an absorbing material housing part which is formed in the cap base; a function liquid absorbing material which is filled inside the absorbing material housing part; an absorbing material urging member which urges the function liquid absorbing material; a sealing member; and a seal fixing member which fixes the sealing member to the cap base. The sealing member is fixed to the cap base in a state of urging the peripheral portion of the absorbing material urging member. There is thus obtained a head cap as well as a liquid droplet ejection apparatus in which the function liquid absorbing material can be easily replaced without impairing the original function of the sealing operation.

9 Claims, 32 Drawing Sheets

HEAD CAP; LIQUID DROPLET EJECTION APPARATUS PROVIDED WITH HEAD CAP; METHOD OF MANUFACTURING LCD DEVICE, ORGANIC EL DEVICE; ELECTRON EMISSION DEVICE, PDP DEVICE, ELECTROPHORETIC DISPLAY DEVICE, COLOR FILTER, AND ORGANIC EL; METHOD OF FORMING SPACER, METALLIC WIRING, LENS, RESIST, AND LIGHT DIFFUSION BODY

BACKGROUND OF THE INVENTION

1. Field of the Invention

This invention relates to: a head cap which comes into close contact with a function liquid droplet ejection head as represented by an ink jet head of an ink jet printer so as to well maintain an ejection nozzle of the function liquid droplet ejection head, as well as a liquid droplet ejection apparatus provided with the head cap; a method of manufacturing a liquid crystal display device, a method of manufacturing an organic electroluminescence (EL) device, a method of manufacturing an electron emission device, a method of manufacturing a plasma display panel (PDP) device, a method of manufacturing an electrophoretic display device, a method of manufacturing a color filter, and a method of manufacturing an organic EL; as well as a method of forming a spacer, a method of forming a metallic wiring, a method of forming a lens, a method of forming a resist, and a method of forming a light diffusion body (or member).

2. Description of the Related Art

In the liquid droplet ejection apparatus of an ink jet printer, or the like, at the time of stopping the operation thereof, a function liquid which has been exposed to the air increases its viscosity to thereby cause the clogging at the ejection nozzles of the function liquid droplet ejection head. As a solution, the liquid droplet ejection apparatus is additionally provided with a cap unit which seals the nozzle surface of the function liquid droplet ejection head and which removes the function liquid whose viscosity has increased, by suction from the ejection nozzles. The cap unit is made up of: a head cap which comes into close contact with the nozzle surface of the function liquid droplet ejection head to thereby seal it; a lifting mechanism which moves the head cap toward, and away from, the function liquid droplet ejection head; and a suction pump which sucks the function liquid from the ejection nozzle through the head cap.

For example, in case the apparatus stops its operation for a long period of time, a so-called capping operation is performed by urging or pushing the head cap against the function liquid droplet ejection head to thereby prevent the function liquid from getting dried. At the time of resuming the operation of the apparatus, a so-called cleaning operation is performed by driving a suction pump in this state to thereby suck the function liquid. Depending on the apparatus, a so-called flushing operation (false ejection or waste ejection) is performed in which, while keeping the head cap slightly apart from the function liquid droplet ejection head, the function liquid is ejected from all of the ejection heads.

This kind of head cap to be used in maintaining (or performing maintenance work of) the function liquid droplet ejection head is provided with: a cap base which has formed a recessed groove on its surface; a function liquid absorbing material which is filed inside the recessed groove; and a sealing packing which seals the nozzle surface. The head cap has assembled therein an absorbing material urging (or pushing) member in order to push the function liquid absorbing material which may be swelled by sucking the function liquid.

The conventional absorbing material urging member is formed by thermally caulking the front end of a plurality of pushing projections which are formed integrally with the cap main body. In other word, by deforming the pushing projections which penetrate through the function liquid absorbing material at a plurality of points by means of thermally pressurizing deformation, the function liquid absorbing material is arranged to be held in position (see Published Unexamined Japanese Patent Application No. 2000-62202 and Published Unexamined Japanese Patent Application No. 2001-322296).

In the conventional head cap having the above-described construction, since the cap main body and the pushing projections are integrally formed, it is necessary, when the function liquid droplet absorbing material is to be replaced, to replace the entire head cap. In the applied art of the liquid droplet ejection apparatus, it is necessary to constitute the head cap by a corrosion-resistant material depending on the function liquid to be used. In such a case, it will be a waste of resources and cost to throw away once for all the entire head cap only to replace the function liquid absorbing material.

SUMMARY OF THE INVENTION

In view of the above disadvantage in the conventional art, this invention has an object of providing a head cap in which the function liquid absorbing material can be easily replaced without impairing the original function of sealing operation, or the like. This invention has also an object of providing: a liquid droplet ejection apparatus provided with the head cap; a method of manufacturing a liquid crystal display device, a method of manufacturing an organic EL device, a method of manufacturing an electron emission device, a method of manufacturing a PDP device, a method of manufacturing an electrophoretic display device, a method of manufacturing a color filter, and a method of manufacturing an organic EL; as well as a method of forming a spacer, a method of forming a metallic wiring, a method of forming a lens, a method of forming a resist, and a method of forming a light diffusion body.

According to this invention, there is provided a head cap comprising: a cap base; an absorbing material housing part which is formed on a surface of the cap base; a function liquid absorbing material which is disposed inside the absorbing material housing part; an absorbing material urging member which urges the function liquid absorbing material; a sealing member which is formed so as to come into intimate contact with a nozzle surface of a function liquid droplet ejection head; and a seal fixing member which fixes the sealing member to the cap base; wherein the sealing member is fixed to the cap base in a state in which the absorbing material urging member is urged.

According to this arrangement, the function liquid absorbing material filled inside the absorbing material housing part of the head cap is urged by the absorbing material urging member, and this absorbing material urging member is urged by the sealing member. Therefore, each of the constituting elements can be taken into pieces simply by removing the seal fixing member out of the cap base, and can also be assembled in sequence. As a result, even if deterioration due to aging or damage may have occurred to any of the function liquid absorbing material and other head cap constituting elements, it is possible to easily and independently replace only the constituting element or elements that require replacement. Further, when the head cap is brought into intimate or close contact with the function liquid droplet ejection head, the sealing member will strongly urge the absorbing material urging member. The function liquid absorbing material is thus adequately urged to thereby surely prevent it from coming into contact with the nozzle surface.

Preferably, the absorbing material housing part comprises a loop-shaped peripheral portion which projects beyond the cap base so as to define a recessed groove which is filled with the function liquid absorbing material, and a peripheral portion of the absorbing material urging member is seated on the loop-shaped peripheral portion.

According to this arrangement, the peripheral portion of the absorbing material urging member is stably urged in a sandwiched manner by the loop-shaped peripheral portion of the cap base and the sealing member. Therefore, the absorbing material urging member urged by the sealing member prevents the inner peripheral portion of the sealing member from falling onto the absorbing material housing part. Further, when the suction operation is performed by bringing the head cap into close contact with the nozzle surface, a leak due to the inclination of the seal member can be prevented.

Preferably, the absorbing material urging member is formed into a small thickness and comprises: a frame-shaped part which urges the peripheral portion of the function liquid absorbing member; and a lattice-shaped part which urges an intermediate portion thereof.

According to this arrangement, the central portion of the function liquid absorbing material can be urged by the lattice-shaped part of the absorbing material urging member. Therefore, even if the function liquid absorbing material gets swelled, it can be held flat in shape. In addition, by forming the absorbing material urging member small in thickness, the absorbing material will never be brought into contact with the nozzle surface even if the head cap is brought into close contact with the nozzle surface of the function liquid droplet ejection head. Still furthermore, since the lattice-shaped part which urges the central portion of the function liquid absorbing material can be formed small also in width, the function liquid can be prevented from remaining or staying on the upper surface of the lattice-shaped part. The thickness of the absorbing material urging member and the width of the lattice-shaped part shall preferably be formed in the order of about 0.3 mm. The absorbing material urging member shall preferably be fabricated by means of electric discharge machining, instead of by pressing, so as to form the lattice-shaped part in as small a width as possible.

Preferably, the frame-shaped part and the lattice-shaped part are formed integral with each other.

According to this arrangement, by forming the frame-shaped part and the lattice-shaped part integrally, the frame-shaped part need not be fixed to the lattice-shaped part and, further, the entire thickness can be made uniform. In addition, even if the frame-shaped part and the lattice-shaped part are formed smaller in thickness and smaller in width, the handling will not be difficult, with the result that the mounting thereof onto the head cap can be made easily.

Preferably, the absorbing material urging member is formed of a stainless steel.

According to this arrangement, the stainless steel hardly gets corroded by the function liquid, i.e., has a high corrosion resistance and a higher mechanical strength than other metallic materials have. Therefore, by forming the absorbing material urging member in a stainless steel, it can be formed smaller in thickness and width than is the case when it is formed in other materials.

Preferably, the sealing member is integrally formed of: a loop-shaped projecting part which comes into intimate contact with the nozzle surface; a loop-shaped urging part which urges the absorbing material urging member; and a loop-shaped fixing part which is fixed to the cap base, and the loop-shaped urging part is formed on a back surface side of the loop-shaped projecting part.

According to this arrangement, the sealing member is constructed such that the adhesion force (reactive force) to be applied to the loop-shaped projecting part is received by the cap base through the loop-shaped urging part. Therefore, the degree of close contact (adhesiveness) is improved when the head cap is brought into close contact with the nozzle surface of the function liquid droplet ejection head. In addition, it is possible to stably fix the sealing member by sandwiching the loop-shaped fixing part between the cap base and the lower surface of the seal fixing member. As a result, the degree of close contact between the cap base and the sealing member can be improved.

Preferably, the seal fixing member is formed into a loop shape and is screwed to the cap base in a state in which the loop-shaped fixing part of the sealing member is urged against the cap base.

According to this arrangement, by employing the screwed construction, the seal fixing member can be firmly fixed in a manner in which the seal fixing member is urged toward the cap base. Therefore, the degree of adhesiveness (or close contact) between the sealing member and the cap base can be improved. Further, the head cap can be taken into pieces of respective constituting elements only by unscrewing. As a result, in case there has occurred deterioration or damage to the function liquid absorbing material and other constituting elements, only the constituting element or elements that are required to be replaced can be independently and easily replaced.

Preferably, the head cap further comprises a cap holder which slidably supports the cap base in a direction of close adhesion, and a spring which urges the cap base, with the cap holder serving as a receiver. The cap holder has formed therein a restricting projection part which restricts a position of the cap base in a slightly inclined state relative to the cap base against the spring.

According to this arrangement, since the cap base is urged by the spring, the sealing member gets closely adhered to the nozzle surface in a manner to follow the nozzle surface when the head cap is urged against the function liquid droplet ejection head. Therefore, the nozzle surface of the function liquid droplet ejection head can be surely sealed. In addition, since the cap base is mounted on the cap holder in a state of being restricted in position in an inclined state, the sealing member departs from one side off from the nozzle surface when the head cap is released from the function liquid droplet ejection head. Therefore, the function liquid inside the head cap can be prevented from splashing.

The liquid droplet ejection apparatus according to this invention comprises: the above-described head cap; the function liquid droplet ejection head; an approaching and departing mechanism for relatively moving the head cap toward, and away from, the function liquid droplet ejection head; and a suction mechanism for sucking a function liquid from the function liquid droplet ejection head through the head cap which is connected to, and adhered to, the head cap.

According to this arrangement, by making the head cap closely adhere to the function liquid droplet ejection head, the evaporation of the function liquid at the front end of the nozzle of the function liquid droplet ejection head can be restricted, thereby preventing the clogging of the nozzle. In addition, by driving the suction mechanism in a state in which the head cap is closely adhered to the function liquid droplet ejection head, the function liquid can be sucked from the nozzle of the function liquid droplet ejection head. It is thus possible to eliminate the nozzle clogging and also to perform an initial filling of the function liquid into the function liquid droplet ejection head. On the other hand, by performing false (or waste) ejection (flushing) of the function liquid from the function liquid droplet ejection head in a state in which the head cap is held apart from the function liquid droplet ejection head, the meniscus in the nozzle can be maintained in an appropriate state. As a result, the function liquid droplet ejection head can be kept in a well-maintained condition. Further, the head cap itself contributes to the saving of resources without sacrificing the function.

A method of manufacturing a liquid crystal display device, according to this invention, in which a multiplicity of filter elements are formed on a substrate of a color filter by using the above-described liquid droplet ejection apparatus comprises: introducing a filter material of each color into the function liquid droplet ejection head; performing a relative scanning between the function liquid droplet ejection head and the substrate through the head unit; and selectively ejecting the filter material to thereby form the multiplicity of filter elements.

A method of manufacturing an organic EL device, according to this invention, in which an EL light-emitting layer is formed on each of a multiplicity of pixels on a substrate by using the above-described liquid droplet ejection apparatus comprises: introducing a light-emitting material of each color into the function liquid droplet ejection head; performing a relative scanning between the function liquid droplet ejection head and the substrate through the head unit; and selectively ejecting the light-emitting material to thereby form the multiplicity of EL light-emitting layers.

A method of manufacturing an electron emission device, according to this invention, in which a multiplicity of fluorescent bodies are formed on electrodes by using the above-described liquid droplet ejection apparatus comprises: introducing a fluorescent material of each color into the function liquid droplet ejection head; performing a relative scanning between the function liquid droplet ejection head and the substrate through the head unit; and selectively ejecting the fluorescent material to thereby form the multiplicity of fluorescent bodies.

A method of manufacturing a PDP device, according to this invention, in which a fluorescent body is formed in each of a multiplicity of recessed portions on a rear substrate by using the above-described liquid droplet ejection apparatus comprises: introducing a fluorescent material of each color into the function liquid droplet ejection head; performing a relative scanning between the function liquid droplet ejection head and the rear substrate through the head unit; and selectively ejecting the fluorescent material to thereby form the multiplicity of fluorescent bodies.

A method of manufacturing an electrophoretic display device, according to this invention, in which an electrophoretic body is formed in each of a multiplicity of recessed portions on an electrode by using the above-described liquid droplet ejection apparatus comprises: introducing an electrophoretic material of each color into the function liquid droplet ejection head; performing a relative scanning between the function liquid droplet ejection head and the electrode through the head unit; and selectively ejecting the electrophoretic material to thereby form the multiplicity of electrophoretic bodies.

As described above, by applying the above-described liquid droplet ejection apparatus to the method of manufacturing an LC device, to the method of manufacturing an organic EL device, to the method of manufacturing an electron emission device, and to the method of manufacturing a PDP, the substrate processing can be performed by the well-maintained function liquid droplet ejection head, and the quality can thus be improved. The electron emission device is a concept inclusive of a so-called field emission display (FED) device and a surface-conduction electron-emitter display (SED) device.

A method of manufacturing a color filter, according to this invention, in which a multiplicity of filter elements are arrayed on a substrate by using the above-described liquid droplet ejection apparatus comprises: introducing a filter material of each color into the function liquid droplet ejection head; performing a relative scanning between the function liquid droplet ejection head and the substrate through the head unit; and selectively ejecting the filter material to thereby form the multiplicity of filter elements.

Preferably, an overcoat film is formed for coating the multiplicity of filter elements and the method further comprises: introducing a translucent coating material into the function liquid droplet ejection head after having formed the filter elements; performing a relative scanning between the function liquid droplet ejection head and the substrate through the head unit; and selectively ejecting the coating material to thereby form the overcoat film.

A method of manufacturing an organic EL, according to this invention, in which a multiplicity of pixels inclusive of EL light-emitting layers are arrayed on a substrate by using the above-described liquid droplet ejection apparatus comprises: introducing a light-emitting material of each color into the function liquid droplet ejection head; performing a relative scanning between the function liquid droplet ejection head and the substrate through the head unit; and selectively ejecting the light-emitting material to thereby form the multiplicity of EL light-emitting layers.

Preferably, a multiplicity of pixel electrodes corresponding to the EL light-emitting layers are formed between the multiplicity of EL light-emitting layers and the substrate, and the method comprises:introducing a liquid electrode material into the function liquid droplet ejection head; performing a relative scanning between the function liquid droplet ejection head and the substrate through the head unit; and selectively ejecting the liquid electrode material to thereby form the multiplicity of pixel electrodes.

Preferably, an opposite electrode is formed to cover the multiplicity of EL light-emitting layers, and the method further comprises: introducing a liquid electrode material into the function liquid droplet ejection head after having formed the EL light-emitting layers; performing a relative scanning between the function liquid droplet ejection head and the substrate through the head unit; and selectively ejecting the liquid electrode material to thereby form the opposite electrode.

A method of forming a spacer, according to this invention, in which a multiplicity of particulate spacers to constitute a minute cell gap between two substrates by using the above-described liquid droplet ejection apparatus comprises: introducing a particulate material constituting the spacers into the function liquid droplet ejection head; performing a relative scanning between the function liquid droplet ejection head and at least one of the substrates through the head unit; and selectively ejecting the particulate material to thereby form the spacers on the substrate.

A method of forming a metallic wiring, according to this invention, in which a metallic wiring is formed on a substrate by using the above-described liquid droplet ejection apparatus comprises: introducing a liquid metallic material into the function liquid droplet ejection head; performing a relative scanning between the function liquid droplet ejection head and the substrate through the head unit; and selectively ejecting the liquid metallic material to thereby form the metallic wiring.

A method of forming a lens, according to this invention, in which a multiplicity of micro-lenses are formed on a substrate by using the above-described liquid droplet ejection apparatus comprises: introducing a lens material into the function liquid droplet ejection head; performing a relative scanning between the function liquid droplet ejection head and the substrate through the head unit; and selectively ejecting the lens material to thereby form the micro-lenses.

A method of forming a resist, according to this invention, in which a resist of an arbitrary shape is formed on a substrate by using the above-described liquid droplet ejection apparatus comprises: introducing a resist material into the function liquid droplet ejection head; performing a relative scanning between the function liquid droplet ejection head and the substrate through the head unit; and selectively ejecting the resist material to thereby form the resist.

A method of forming a light diffusion body, according to this invention, in which a multiplicity of light diffusion bodies are formed on a substrate by using the above-described liquid droplet ejection apparatus comprises: introducing a light diffusion material into the function liquid droplet ejection head; performing a relative scanning between the function liquid droplet ejection head and the substrate through said head unit; and selectively ejecting the light diffusion material to thereby form the multiplicity of light diffusion bodies.

In this manner, by applying the above-described apparatus for ejecting liquid droplet to the method of manufacturing a color filter, to the method of manufacturing an organic EL, to the method of forming a spacer, to the method of forming a metallic wiring, to the method of forming a lens, to the method of forming a resist, and to the method of forming a light diffusion body, the quality can be improved in each of the methods.

BRIEF DESCRIPTION OF THE DRAWINGS

The above and other objects and the attendant features of this invention will become readily apparent by reference to the following detailed description when considered in conjunction with the accompanying drawings wherein.

DETAILED DESCRIPTION OF THE PREFERRED EMBODIMENTS

With reference to the accompanying drawings, an explanation will now be made about an embodiment of this invention. This embodiment shows a liquid droplet ejection apparatus of this invention as built in, or assembled into, a manufacturing line for manufacturing an organic electroluminescence (EL) device which is a kind of a so-called flat panel display. Namely, in the manufacturing line, function liquids such as light-emitting materials, or the like, are introduced into a plurality of function liquid droplet ejection heads to thereby form a hole injection/transport layer for each of pixels and a light-emitting layer for each of colors of red (R), green (G) and blue (B), which constitute the light emitting elements of the organic EL device.

A brief description will first be made about the structure of the organic EL device and a method of manufacturing thereof, and a description will then be made about an organic EL device manufacturing apparatus which is made up of a liquid droplet ejection apparatus and auxiliary pieces of equipment which are built in the manufacturing line.

In the descriptions of this invention, constituting elements, parts, or the like, will sometimes be referred to in a singular form (e.g., an element, a part, or the like) where there are actually a plurality of such elements, parts, or the like. In such a case, it is to be understood that such a reference is being made to a typical or representative one out of a plurality of elements, parts, or the like, partly to simplify the description.

Figure 1:
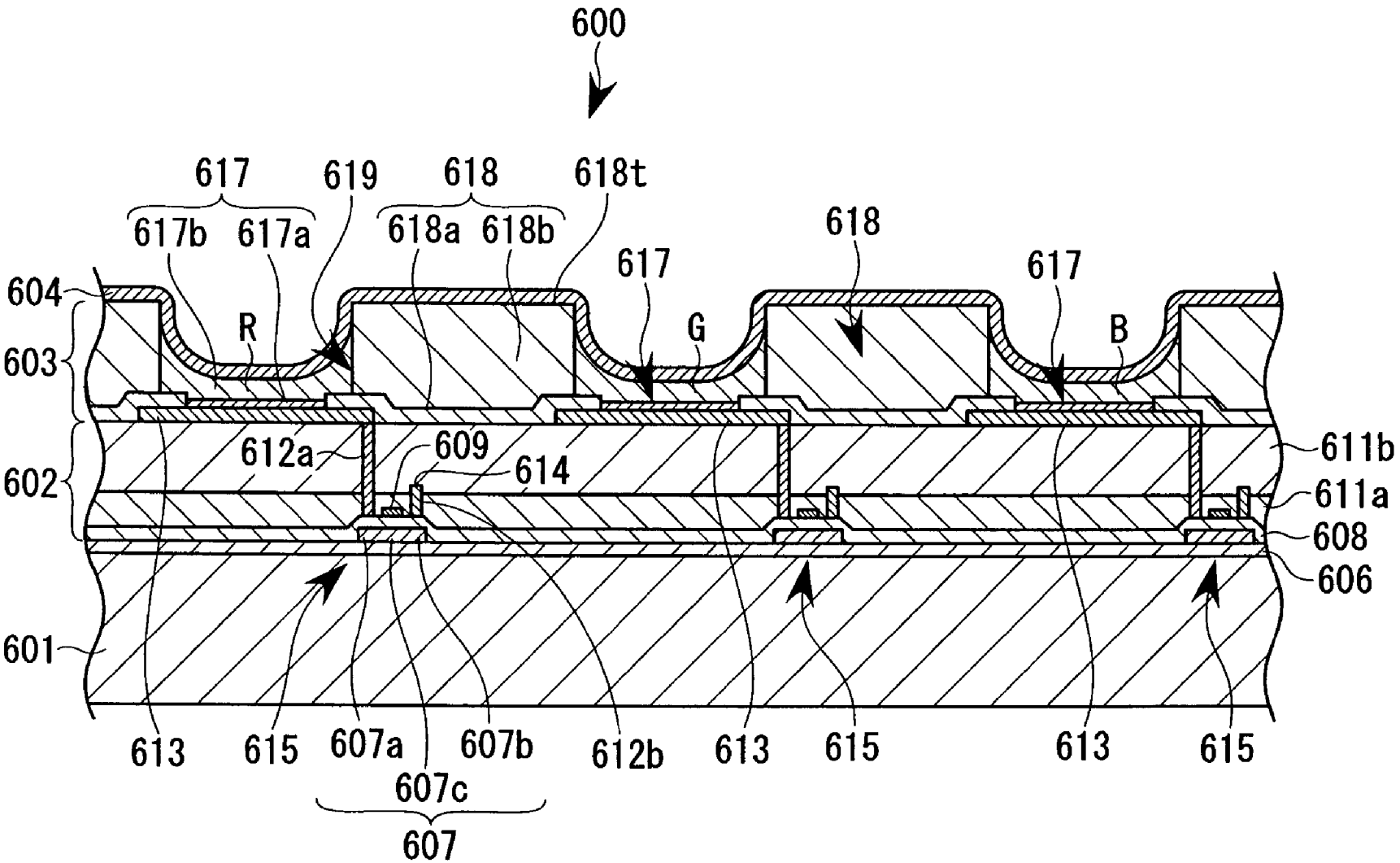
FIG. 1 is a sectional view of an important portion of a display device in the form of an organic EL device.

FIG. 1 is a sectional view showing an important portion of a display region (hereinafter referred to as a display device 600) of an organic EL device which is a kind of a flat panel display according to this invention.

This display device 600 is made up of a circuit element part 602, a light-emitting element part 603 and a cathode 604 all of which are laminated on a substrate (W) 601.

This display device 600 is arranged such that the light originating from the light-emitting element part 603 toward the substrate 601 penetrates through the circuit element part 602 and the substrate 601 to thereby go out toward an observer, and that the light originating from the light-emitting element part 603 toward the side opposite to the substrate 601 is reflected on the cathode 604 and then penetrates through the circuit element part 602 and the substrate 601 to thereby go out toward the observer.

Between the circuit element part 602 and the substrate 601, there is formed a substrate protection film 606 which is made of a silicon oxide film. An island-shaped semiconductor film 607 which is made of a polycrystalline silicon is formed on this substrate protection film 606 (on the side of the light-emitting element part 603). A source region 607*a* and a drain region 607*b* are formed respectively in the left region and in the right region of this semiconductor film 607 by means of high-concentration cation implantation. The central portion which is free from the cation implantation forms a channel region 607*c*.

The circuit element part 602 has formed therein a transparent gate insulation film 608 which covers the substrate protection film 606 and the semiconductor film 607. In that position on this gate insulation film 608 which corresponds to the channel region 607*c* of the semiconductor film 607, there is formed a gate electrode 609 which is made of Al, Mo, Ta, Ti, W, or the like. A transparent first interlayer insulation film 611*a* and second interlayer insulation film 611*b* are formed on the gate electrode 609 and the gate insulation film 608. Contact holes 612*a*, 612*b* which are in communication with the source region 607*a* and the drain region 607*b*, respectively, are formed in a manner to penetrate through the first and second interlayer insulation films 611*a*, 611*b*.

On top of the second interlayer insulation film 611*b* is formed by patterning a transparent pixel electrode 613 which is made of indium tin oxide (ITO), or the like, in a predetermined shape. This pixel electrode 613 is connected to the source region 607*a* through the contact hole 612*a*.

On top of the first interlayer insulation film 611*a* is formed a power source line 614, which is connected to the drain region 607*b* through the contact hole 612*b*.

As described above, the circuit element part 602 has respectively formed therein a driving thin film transistor 615 which is connected to each of the pixel electrodes 613.

The light-emitting element part 603 is made up of: a function layer 617 which is laminated on each of the plurality of pixel electrodes 613; and a bank part 618 which is disposed between the respective pixel electrodes 613 and the function layers 617 to thereby partition each of the function layers 617.

The light emitting element is constituted by the pixel electrode 613, the function layer 617, and the cathode 604 which is formed on the function layer 617. The pixel electrode 613 is formed by patterning into a rectangular shape as seen in plan view and the bank part 618 is formed between each of the pixel electrodes 613.

The bank part 618 is made up of: an inorganic-matter bank layer 618*a* which is formed by an inorganic material such as SiO, $SiO_2$, $TiO_2$, or the like (first bank layer); and an organic-matter bank layer 618*b* (second bank layer) which is laminated on top of this inorganic-matter bank layer 618*a* and is trapezoidal in cross section. The inorganic-matter bank layer 618*b* is formed by a resist which is superior in resistance against heat and solvent, such as an acrylic resin, polyimide resin, or the like. This bank part 618 is partially formed in a state of being overlapped with peripheral portion of the pixel electrode 613.

Between each of the bank parts 618 is formed an opening part 619 which gradually expands upward relative to the pixel electrode 613.

The function layer 617 is made up of: a hole injection/transport layer 617*a* which is formed in a laminated state on the pixel electrode 613 inside the opening part 619; and a light-emitting layer 617*b* which is formed on the hole injection/transport layer 617*a*. Another function layer having another function may further be formed next to this light-emitting layer 617*b*. For example, an electron transporting layer may be formed.

The hole injection/transport layer 617*a* has a function of transporting the holes from the pixel electrode 613 side for injection into the light-emitting layer 617*b*. This hole injection/transport layer 617*a* is formed by ejecting a first composition of matter (function liquid) containing therein a hole injection/transport layer forming material. As the hole injection/transport forming material, there may be used, for example, a mixture of a polythiophene derivative such as polyethylenedioxythiophene and polystyrenesulfonic acid.

The light-emitting layer 617*b* emits light in red (R), green (G) or blue (B) and is formed by ejecting a second composition of matter containing therein a light-emitting layer forming material (light-emitting material). As a solvent (non-polar solvent) for the second composition of matter, the one which is insoluble to the hole injection/transport layer 617*a* is preferable, such as cyclohexylbenzene, dihydrobenzofuran, trimethylbenzene, tetramethylbenzene, or the like. By using this kind of non-polar solvent as the second composition of matter for the light-emitting layer 617*b*, the light-emitting layer 617*b* can be formed without dissolving again the hole injection/transport layer 617*a*.

The light-emitting layer 617*b* is so arranged that the holes to be injected from the hole injection/transport layer 617*a* and the electrons to be injected from the cathode 604 get re-combined to thereby emit light.

The cathode 604 is formed in a state of covering the entire surface of the light-emitting element part 603 and functions, in a pair with the pixel electrode 613, to cause the electric current to flow through the function layer 617. A sealing member (not illustrated) is disposed on this cathode 604.

A description will now be made about the manufacturing steps of the above-described display device with reference to FIGS. 2 through 10.

Figure 2:
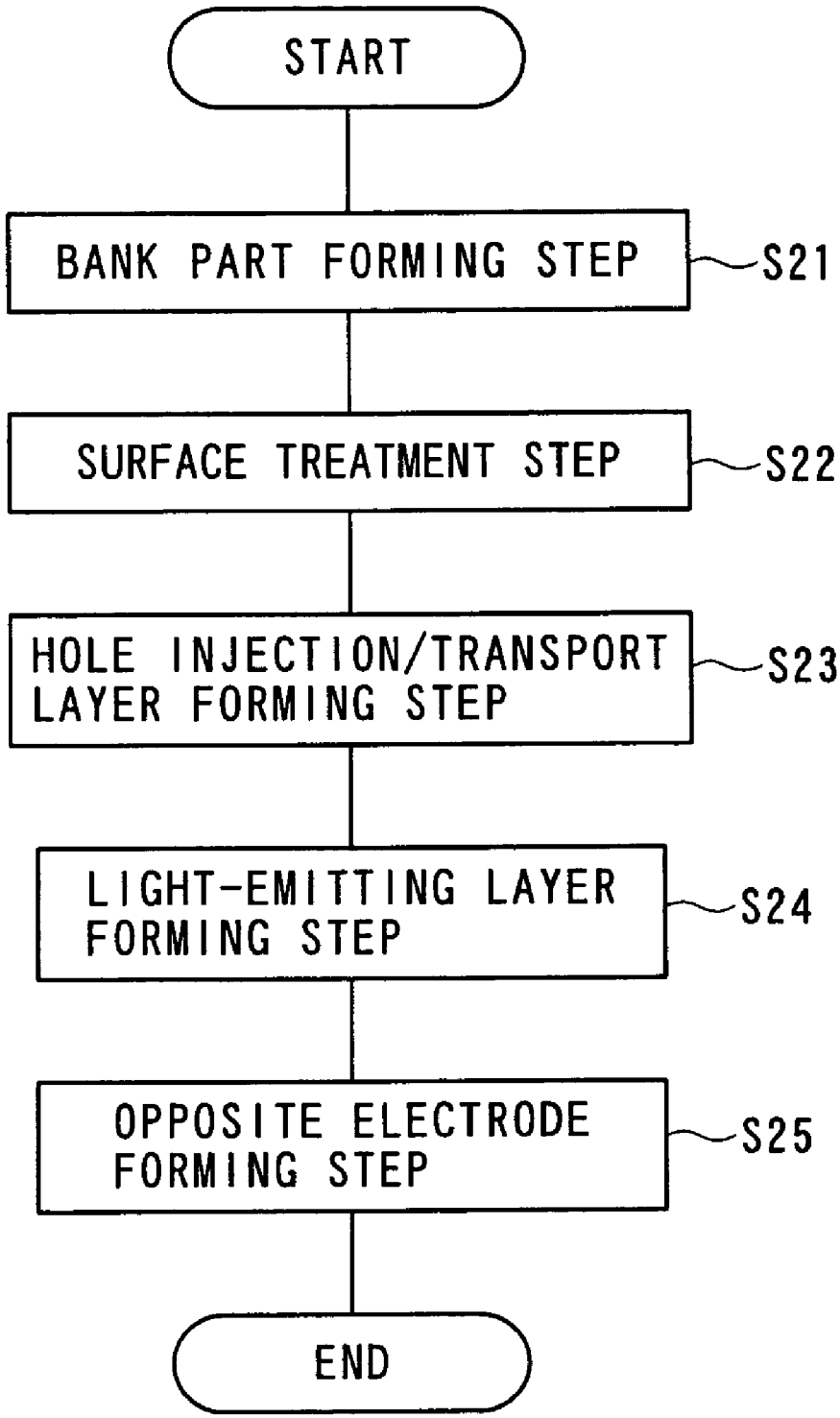
FIG. 2 is a flow chart showing the steps of manufacturing the display device in the form of the organic EL device.

As shown in FIG. 2, the display device 600 is manufactured by the following steps, i.e., a bank part forming step (S21), a surface treatment step (S22), a hole injection/transport layer forming step (S23), a light-emitting layer forming step (S24), and an opposite (or counter) electrode forming step (S25). The manufacturing steps need not be limited to the illustrated example, but may omit some of them or may add some other steps.

Figure 3:
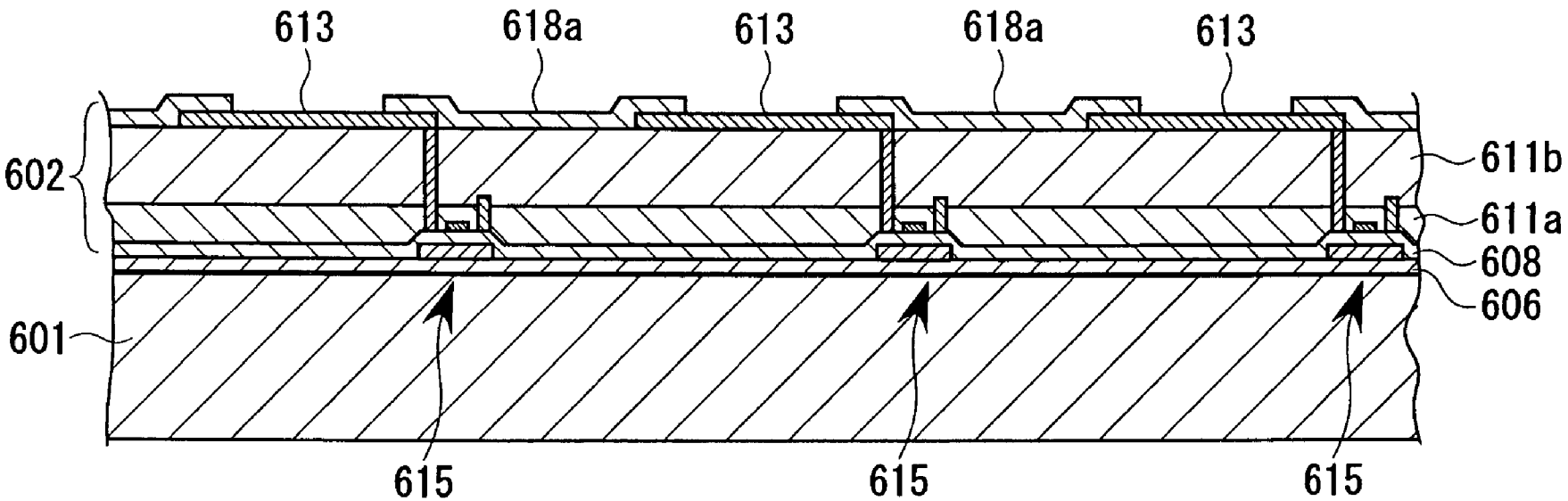
FIG. 3 is a process drawing showing the formation of an inorganic bank layer.

First, at the bank part forming step (S21), as shown in FIG. 3, the inorganic-matter bank layer 618*a* is formed on the second interlayer insulation film 611*b*. This inorganic-matter bank layer 618*a* is formed by patterning this inorganic-matter film by means of lithographic technology, or the like, after having formed an inorganic-matter film in a position in which the inorganic-matter bank layer 618*a* is to be formed. The inorganic-matter bank layer 618*a* is partly so formed as to overlap with the peripheral portion of the pixel electrode 613.

Figure 4:
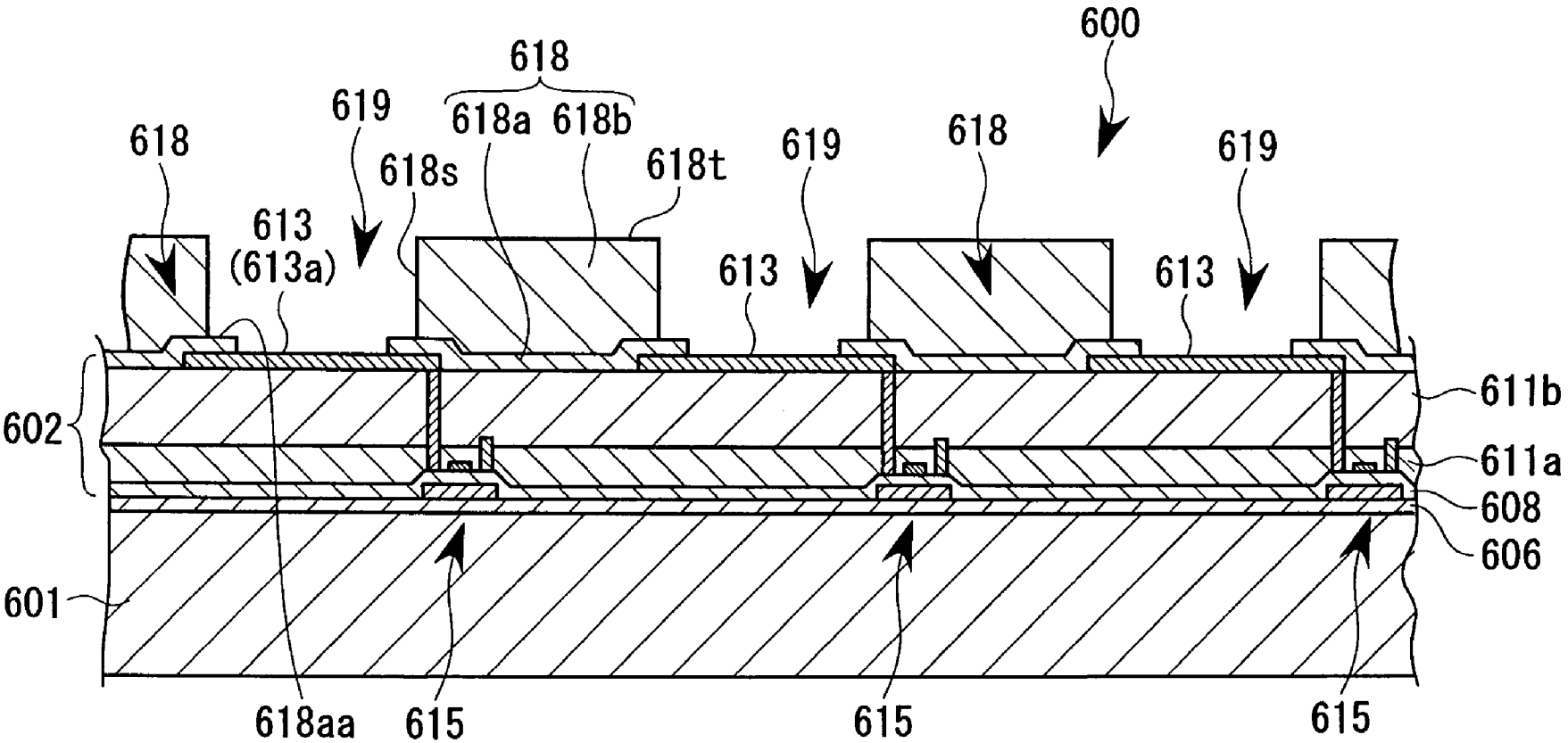
FIG. 4 is a process drawing showing the formation of the organic bank layer.

Once the inorganic-matter bank layer 618*a* has been formed, an organic-matter bank layer 618*b* is formed on the inorganic-matter bank layer 618*a* as shown in FIG. 4. This organic-matter bank layer 618*b* is also formed by patterning by means of lithographic technology, or the like.

The bank part 618 is formed in this manner. As a consequence, there is formed an opening part 619 between respective bank parts 618. The opening part 619 opens upward relative to the pixel electrode 613 and defines the pixel region.

At the surface treatment step (S22), the processing for giving an affinity to liquid (also referred to as liquid-affinity) and the processing for giving a repellency to liquid (also referred to as liquid-repellency) are performed. The regions in which the liquid-affinity processing is performed are a first laminated portion 618*aa* of the inorganic-matter bank layer 618*a* and the electrode surface 613*a* of the pixel electrode 613. These regions are surface-treated to have liquid-affinity characteristics by plasma processing with, e.g., oxygen as the processing gas. This plasma processing serves the dual function of cleaning the ITO which is the pixel electrode 613.

The liquid-repellency processing is performed on wall surfaces 618*s* of the organic-matter bank layer 618*b* and on the upper surface 618*t* of the organic-matter bank layer 618*b*. The surfaces are fluoridated (i.e., processed to have a repellency to a liquid) by plasma processing using, e.g., methane tetrafluoride as a processing gas.

As a result of this surface treatment step, when the function layer 617 is formed by using a function liquid droplet ejection head (to be described hereinafter), the function liquid droplet can more surely reach (or caused to hit) the pixel region. In addition, the function liquid droplet once hit the pixel region is prevented from flowing over (or out of) the opening part 619.

Figure 12:
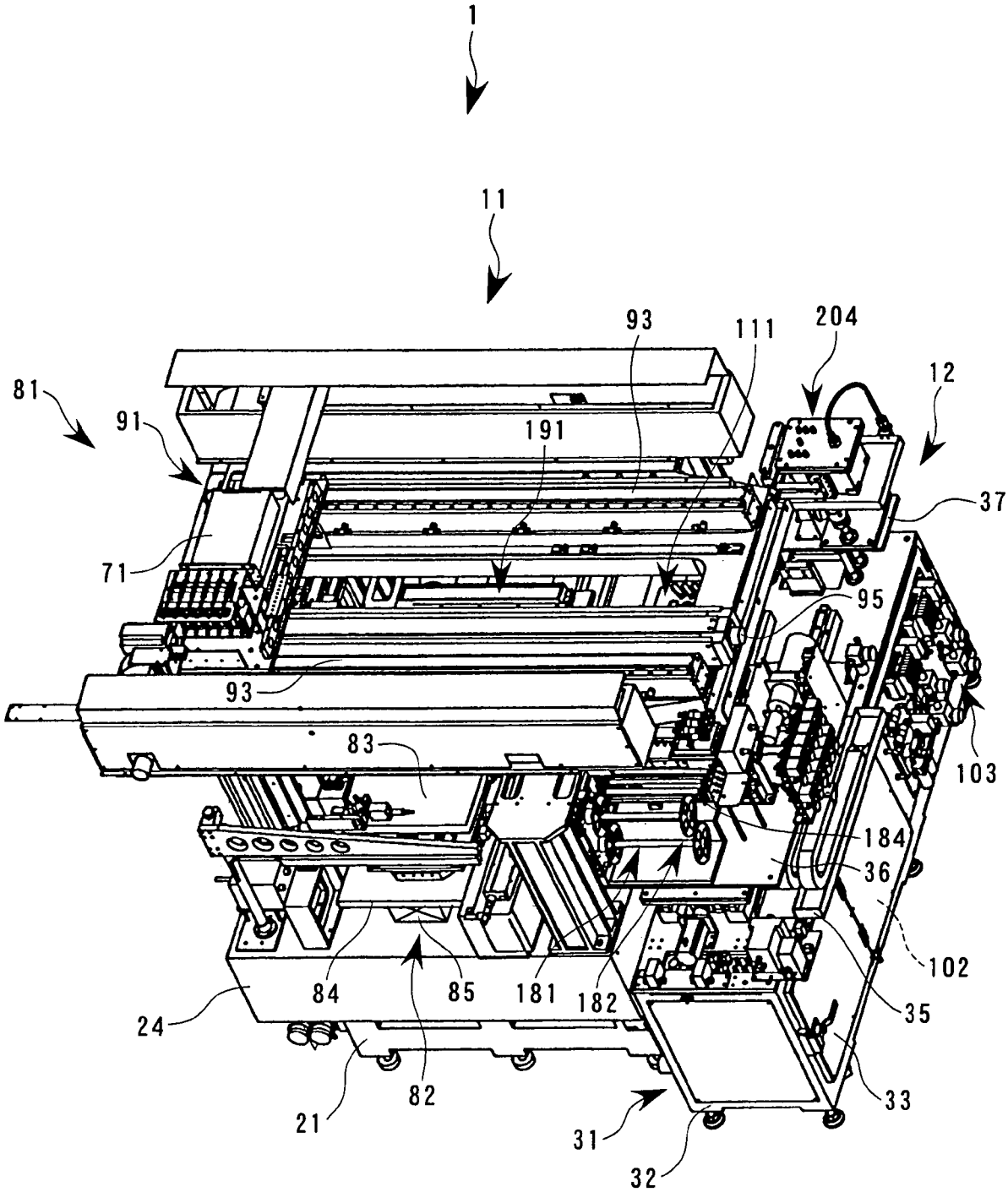
FIG. 12 is a perspective external view of a function liquid droplet ejection apparatus according to this invention.

By passing through the above-described steps, a display device substrate 600A can be obtained. This display device substrate 600A is mounted in position on an X-axis table 82 of the liquid droplet ejection apparatus 1 as shown in FIG. 12, and the following hole injection/transport layer forming step (S23) and the light-emitting layer forming step (S24) are performed.

Figure 5:
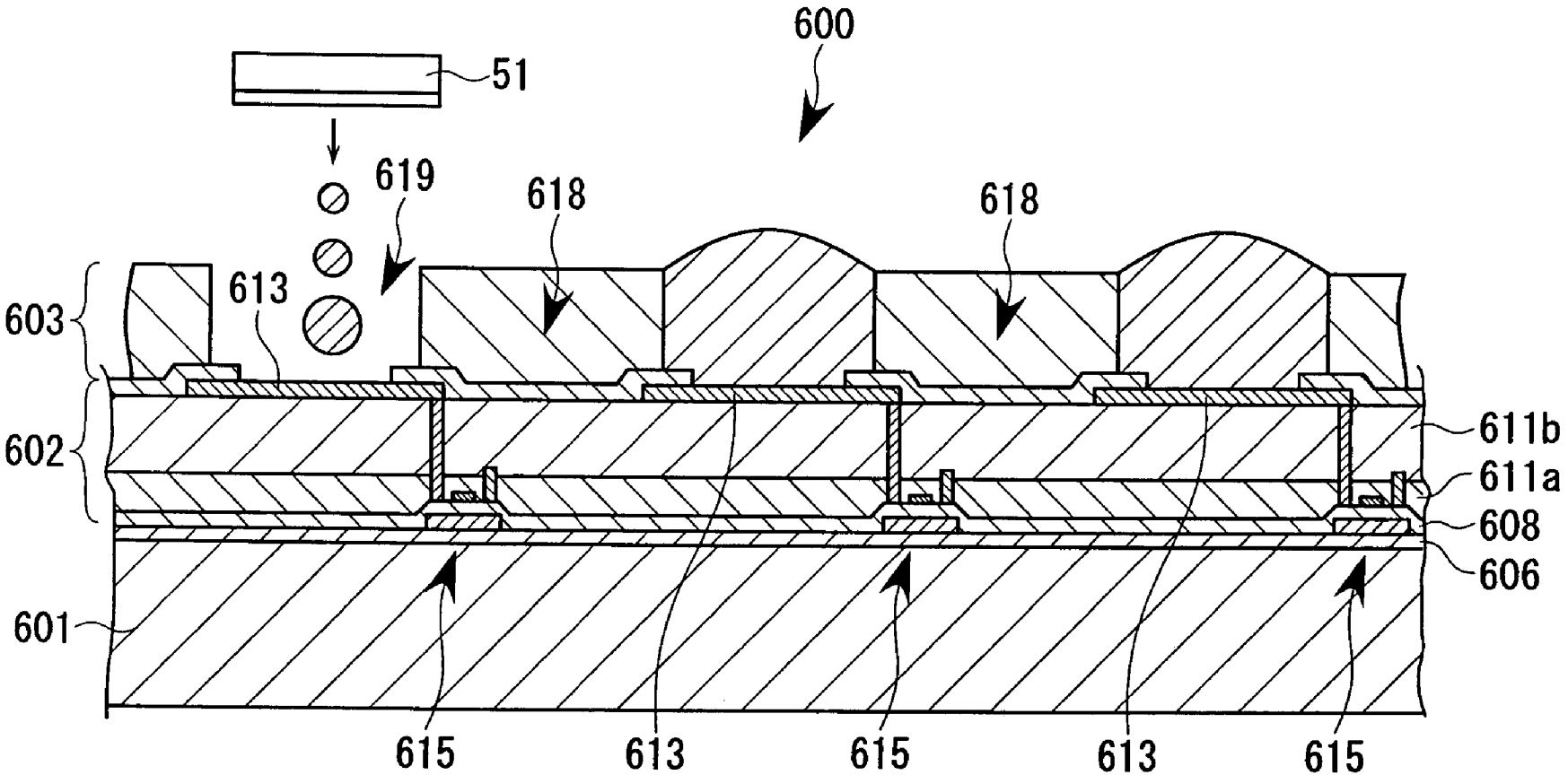
FIG. 5 is a process drawing showing the process of forming a hole injection/transport layer.
Figure 6:
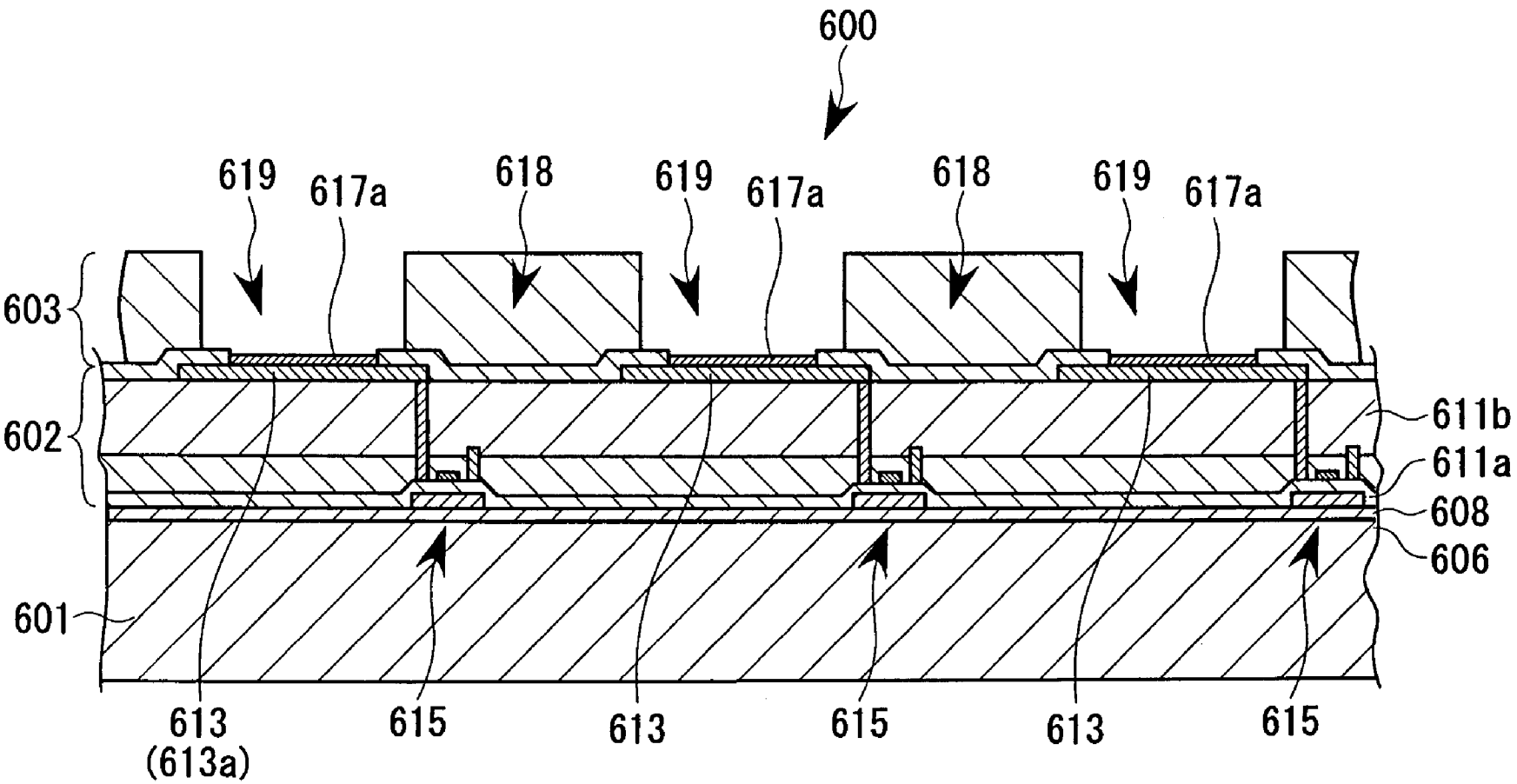
FIG. 6 is a process drawing showing the state in which the hole injection/transport layer has been formed.

As shown in FIG. 5, at the hole injection/transport layer forming step (S23), a first composition of matter containing therein a hole injection/transport layer forming material is ejected from the function liquid droplet ejection head 51 toward (or into) each of the opening parts 619 which is the pixel region. Thereafter, as shown in FIG. 6, a drying processing and a heat treatment processing are performed to thereby evaporate the polar solvent contained in the first composition of matter. The hole injection/transport layer 617*a* is thus formed on the pixel electrode 613 (electrode surface 613*a*). A description will now be made about the light-emitting layer forming step (S24). At this light-emitting layer forming step, in order to prevent the hole injection/transport layer 617*a* from being dissolved again, as described above, a non-polar solvent which is insoluble to the hole injection/transport layer 617*a* is used as the second composition of matter to be used in forming the light-emitting layer.

On the other hand, the hole injection/transport layer 617*a* is low in affinity to the non-polar solvent, there is the following possibility. Namely, even if the second composition of matter containing therein the non-polar solvent is ejected on the hole injection/transport layer 617*a*, it will not be possible to closely adhere together the hole injection/transport layer 617*a* and the light-emitting layer 617*b*, or to uniformly coat the light-emitting layer 617*b*.

As a solution, in order to enhance the affinity of the surface of the hole injection/transport layer 617*a* to the light-emitting layer forming material, it is preferable to perform the surface treatment (surface modification treatment) before forming the light-emitting layer. This surface treatment is performed by coating the hole injection/transport layer 617*a* with a surface modification material which is a solvent same as, or similar to, the non-polar solvent of the second composition of matter to be used in forming the light-emitting layer, and then drying it.

By performing this kind of treatment, the surface of the hole injection/transport layer 617*a* gets familiar with the non-polar solvent. At the subsequent steps, it becomes thus possible to uniformly coat the hole injection/transport layer 617*a* with the second composition of matter containing therein the light-emitting layer forming material.

Figure 7:
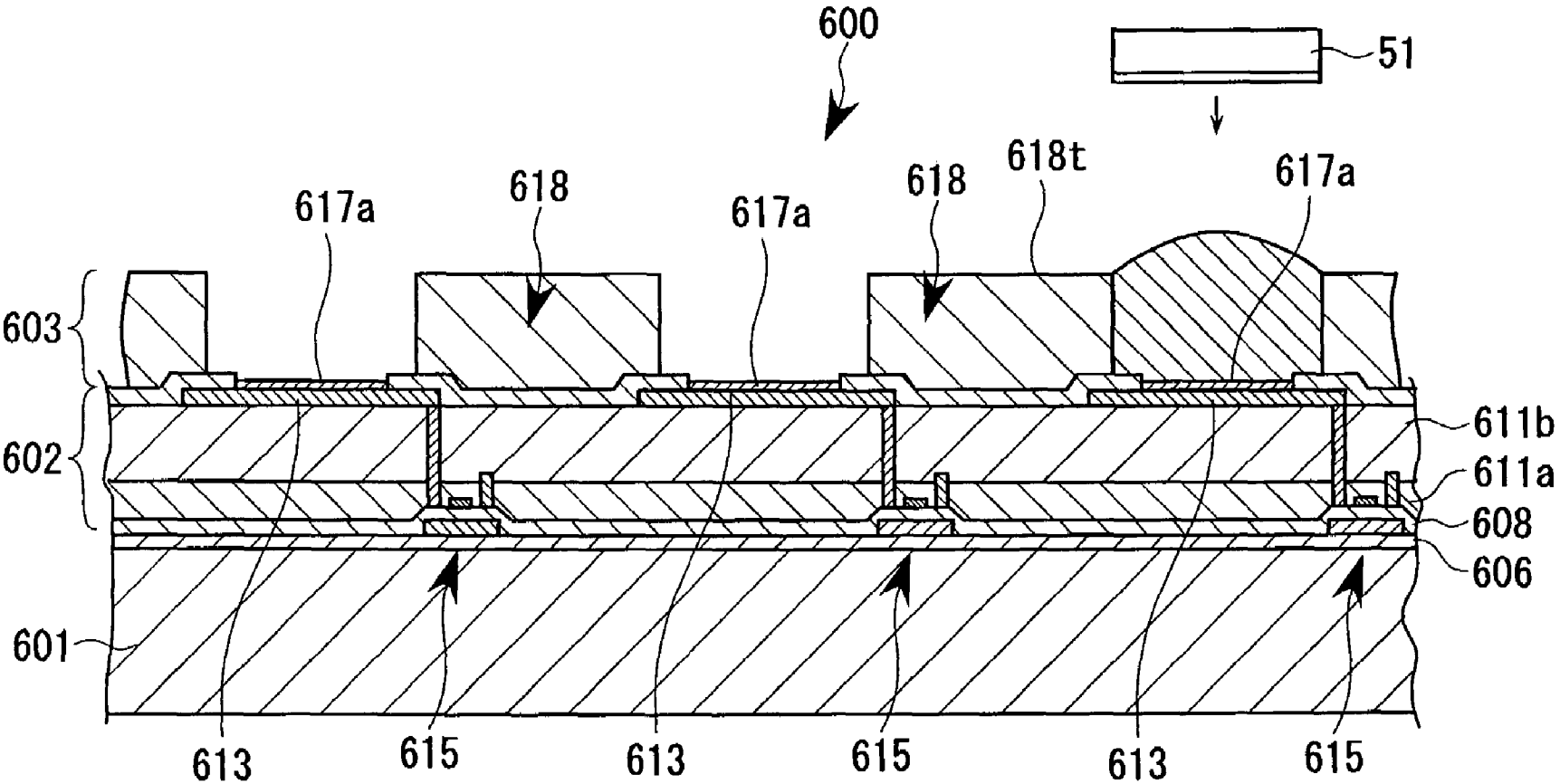
FIG. 7 is a process drawing showing the process of forming a blue-color light emitting layer.

Then, as shown in FIG. 7, the second composition of matter containing therein the light-emitting layer forming material corresponding to any one of the colors (blue in the example in FIG. 7) is injected or shot by a predetermined amount as the function liquid droplet into the pixel region (opening part 619). The second composition of matter injected into the pixel region is spread over the hole injection/transport layer 617*a* to thereby fill the opening part 619. Even in case the second composition of matter deviates from the pixel region to thereby hit or reach the upper surface 618*t* of the bank part 618, the second composition of matter becomes easily rolled into the opening part 619 because this upper surface 618*t* has been subjected to the liquid-repellency processing as described above.

Figure 8:
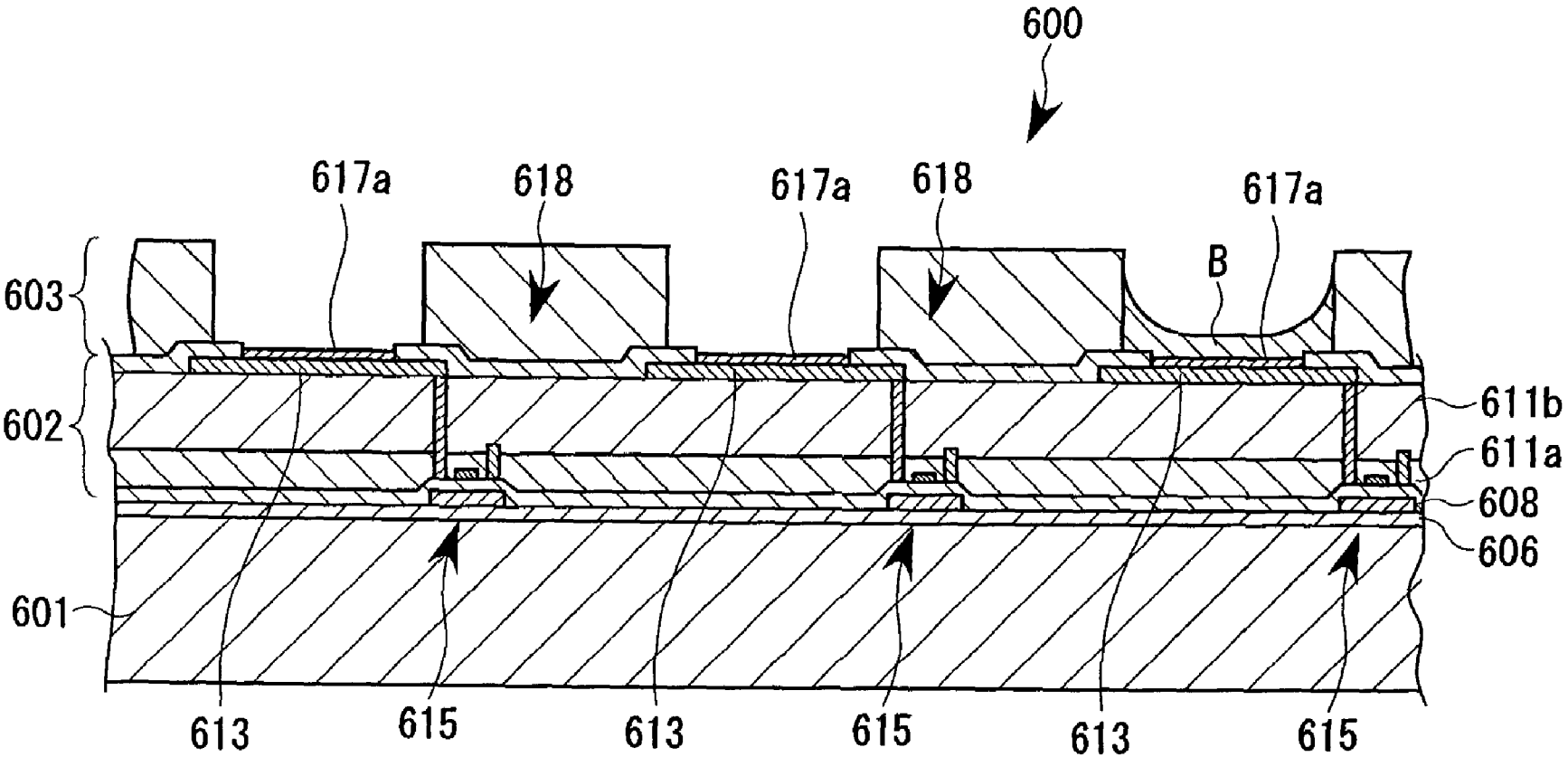
FIG. 8 is a process drawing showing the state in which the blue-color light emitting layer has been formed.

Thereafter, by performing the drying step, or the like, the ejected second composition of matter is dried and the non-polar solvent contained in the second composition of matter is evaporated. As shown in FIG. 8, the light-emitting layer 617*b* is thus formed on the hole injection/transport layer 617*a*. In this particular example, the light-emitting layer 617*b* corresponding to the blue color (B) has been formed.

Figure 9:
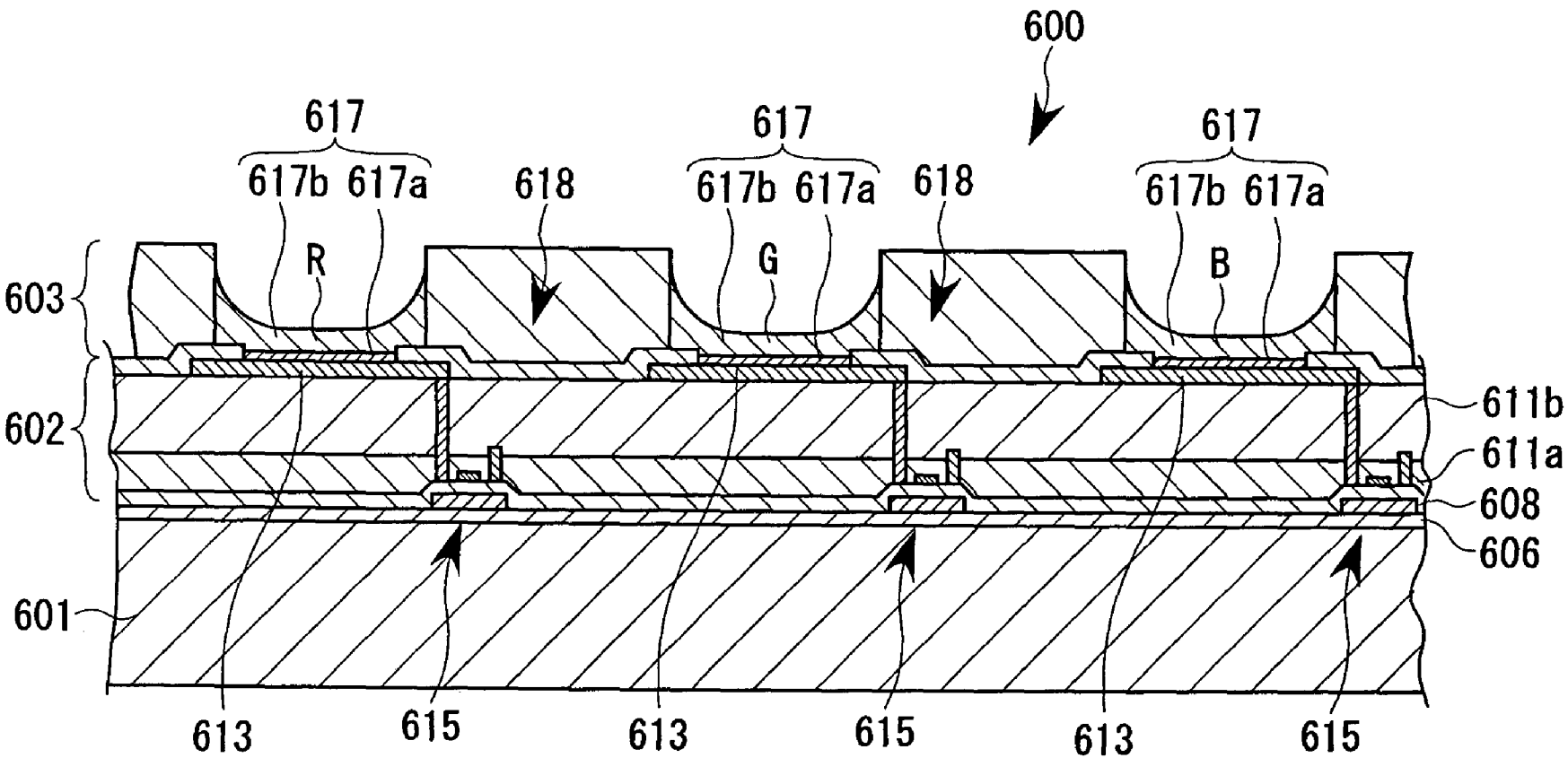
FIG. 9 is a process drawing showing the state in which the light emitting layers of respective colors have been formed.

In the same manner, by using the function liquid droplet ejection head 51, the similar steps as in the case of the above-described light-emitting layer 617*b* corresponding to blue color are sequentially performed as shown in FIG. 9, thereby forming the light-emitting layers 617*b* corresponding to the other colors (red and blue). The order of forming the light-emitting layer 617*b* is not limited to the one in this example, but may be arbitrarily decided. For example, it is possible to determine the order of forming steps depending on the light-emitting layer forming materials. The stripe array, mosaic array, delta array, or the like, are available as the arrangement pattern of three colors of red, green, and blue.

In the manner as described above, the hole injection/transport layer 617*a* and the light-emitting layer 617*b* are formed on the pixel electrode 613. The manufacturing step then transfers to the opposite electrode forming step (S25).

Figure 10:
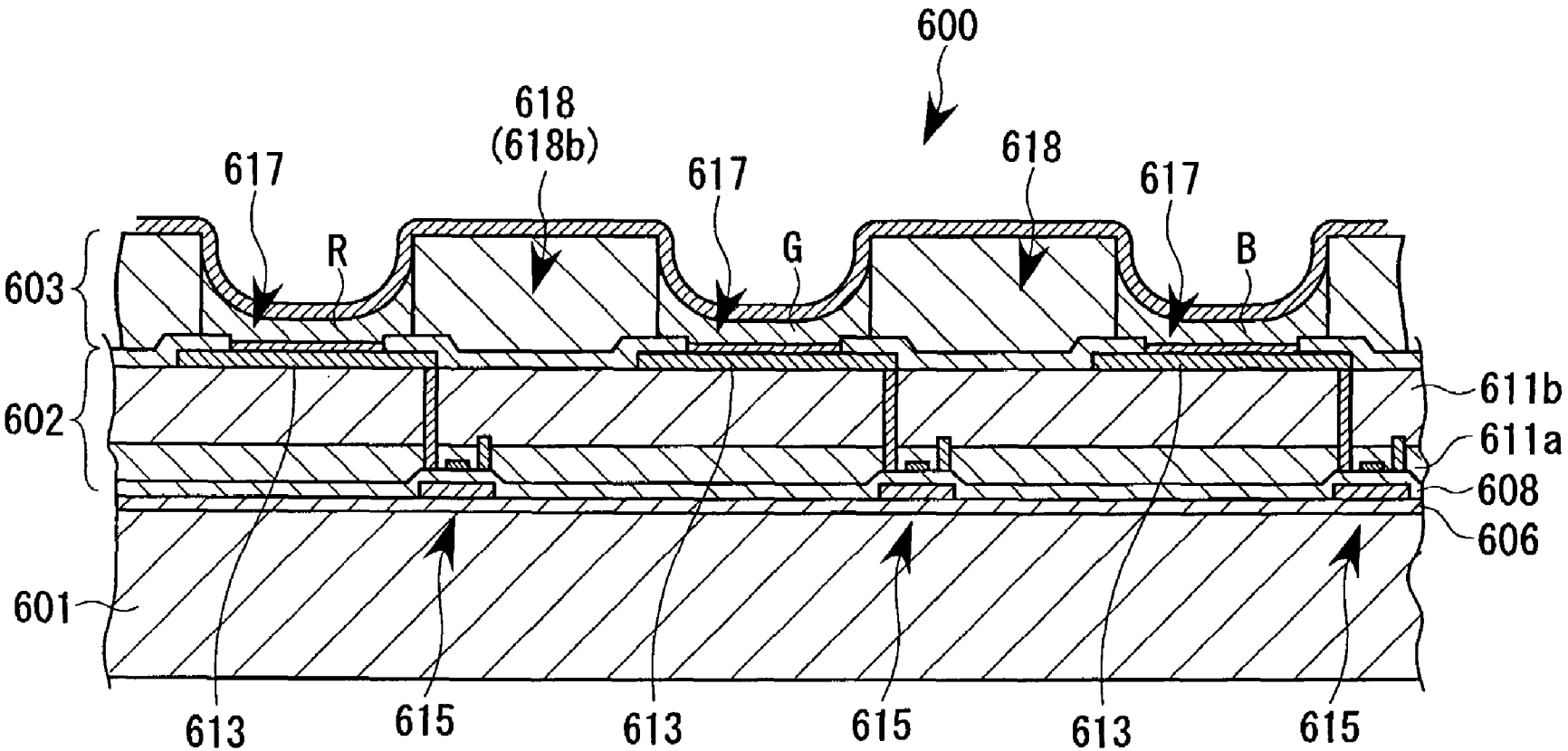
FIG. 10 is a process drawing showing the process of forming a cathode.

At the opposite electrode forming step (S25), as shown in FIG. 10, a cathode electrode 604 (opposite or counter electrode) is formed over the entire surface of the light-emitting layer 617*b* and the organic-matter bank layer 618*b* by means of vapor deposition method, sputtering method, chemical vapor deposition (CVD) method, or the like. In this example, the cathode electrode 604 is constituted by laminating, e.g., a calcium layer and an aluminum layer.

On top of this cathode 604, there is formed, depending on necessity, an electrode in the form of an Al film, Ag film or a protection film in the form of $SiO_2$, SiN, or the like, for prevention of oxidation.

Once the cathode 604 has been formed in this manner, there are performed a sealing process in which the upper part of the cathode 604 is sealed by a sealing material, and a wiring process, or the like, whereby the display device 600 is obtained.

A description will now be made about an apparatus for manufacturing an organic EL. In the apparatus for manufacturing an organic EL, a liquid droplet ejection apparatus 1 (FIG. 11) is used to perform the scanning of the function liquid droplet ejection head 51 while ejecting the liquid function material, in order to cope with the steps of carrying out the liquid droplet ejection method in the process of manufacturing the above-described organic EL, i.e., the light-emitting element forming step (hole injection/transport layer forming step and light-emitting layer forming step), and the surface modification step (see FIG. 11).

For example, a hole injection layer forming equipment (not illustrated) to perform the hole injection/transport layer forming step is made up of: a liquid droplet ejection apparatus 1 which has mounted thereon a function liquid droplet ejection head 51 which introduces a first liquid droplet (hole injection layer material); a drying apparatus 3; a substrate transporting apparatus 2; as well as a chamber apparatus 4 for housing the above. The chamber apparatus 4 is provided with a means for performing the hole injection/transport layer forming step in an inert gas atmosphere.

Similarly, a surface modification equipment (not illustrated) for performing the surface modification step, and the light-emitting layer forming equipment B for forming the light-emitting layer are respectively provided with: a liquid droplet ejection apparatus 1 which has mounted thereon a function liquid droplet ejection head 51 for introducing therein the function material; a drying apparatus 3; a substrate transport apparatus 2; and a chamber apparatus 4 which houses the above and which is provided with a means for performing the light-emitting layer forming step in an inert gas atmosphere. In the light-emitting layer forming equipment B, the liquid droplet ejection apparatus 1, the drying apparatus 3, the substrate transport apparatus 2, and the chamber apparatus 4 are provided in three sets to cope with each of the three different colors of red (R), green (G), and blue (B).

Each of the liquid droplet ejection apparatuses 1 to be used in the apparatus for manufacturing the organic EL device has the same construction except for the fact that the liquid function material to be introduced into each of the function liquid droplet ejection heads 51 is different from one another. In addition, each of the drying apparatuses 3, each of the substrate transport apparatuses 2, and each of the chamber apparatuses 4 have the construction which is the same as that of the others. Therefore, provided that the time required for replacing the function liquid droplet ejection head 51 and the time for replacing the system for supplying the liquid function material are neglected, the organic EL device can be manufactured by one arbitrary set of equipment (liquid droplet ejection apparatus 1, drying apparatus 3, substrate transport apparatus 2, and chamber apparatus 4). Therefore, a description will now be made about a series of flows in each of the apparatus arrangement by picking up as an example one set of equipment on the left end in FIG. 11, i.e., the liquid droplet ejection apparatus 1, the drying apparatus 3, the substrate transport apparatus 2, and the chamber apparatus 4 for forming the light-emitting layer of blue (B) color.

Figure 11:
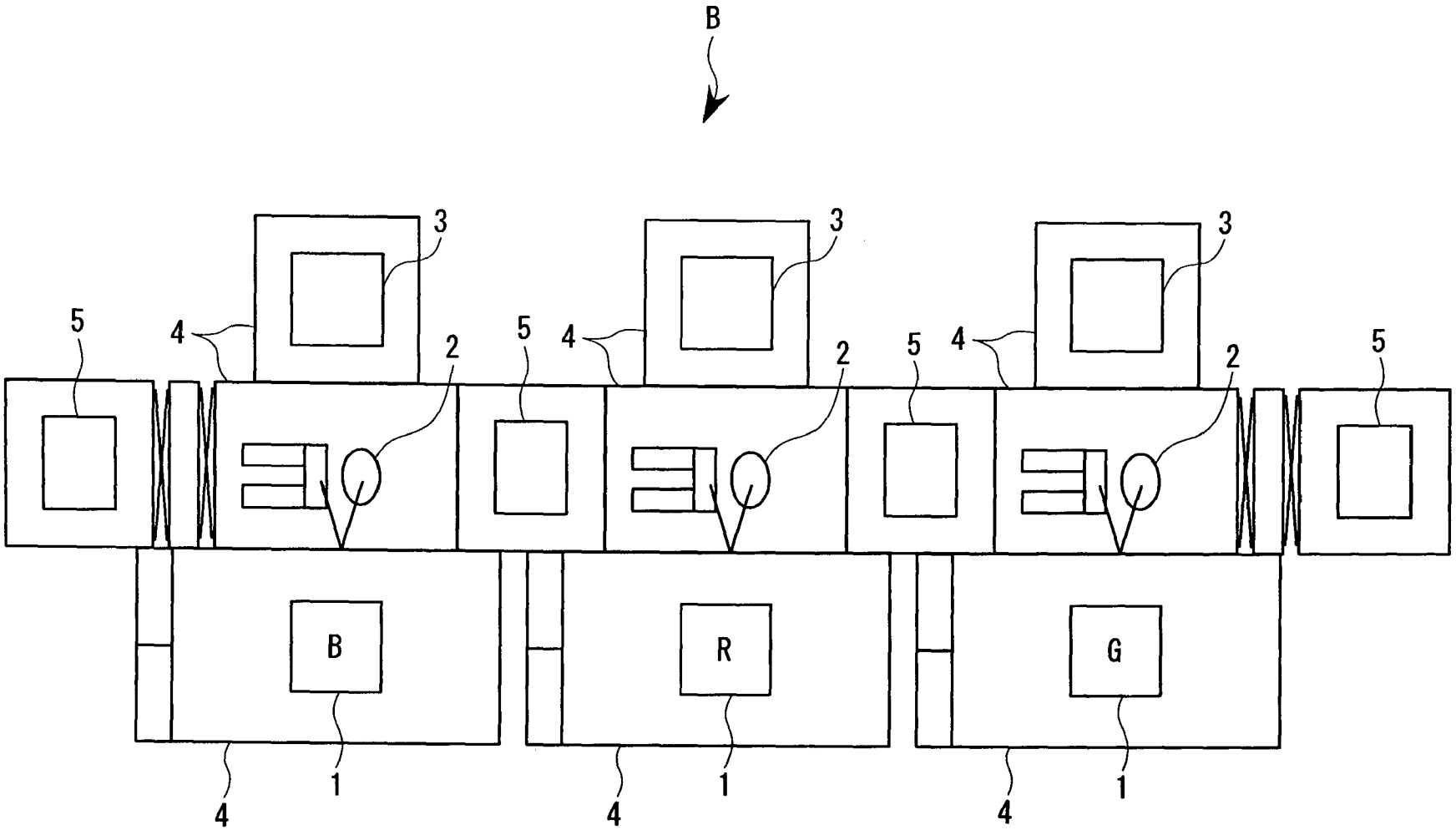
FIG. 11 is a schematic diagram of a light emitting layer forming equipment to be used in a method of manufacturing an organic EL device according to this invention.

A substrate which has passed through the bank part forming step and the plasma processing step is transported by an apparatus (not illustrated) from a substrate transfer apparatus 5 which is positioned in the left end in FIG. 11 to the substrate transport apparatus 2. Then, the substrate changes its direction and posture by the substrate transport apparatus 2 and is transported into the liquid droplet ejection apparatus 1 for being set in position therein. Thereafter, in an inert gas atmosphere inside the chamber apparatus 4, the second liquid droplet ejection step is performed. The liquid droplet ejection apparatus 1 ejects, by the function liquid droplet ejection head 51, a light-emitting material (liquid droplets) of blue color into a multiplicity of pixel regions (opening parts 619) of the substrate.

The substrate having coated thereon the light-emitting material is transferred from the liquid droplet ejection apparatus 1 to the substrate transport apparatus 2 for further introduction into the drying apparatus 3. In the drying apparatus 3, the substrate is exposed to a high-temperature inert-gas atmosphere for a predetermined period of time to thereby evaporate the solvent contained in the light-emitting material (second drying step). The substrate is again introduced into the liquid droplet ejection apparatus 1 to perform the second liquid droplet ejection step. In other words, the second liquid droplet ejection step and the second drying step are repeated several times. When the light-emitting layer 617*b* has attained a desired film thickness, the substrate is transported by the substrate transport apparatus 2 in order to form the light-emitting layer 617*b* of red color. Once the light-emitting layer 617*b* of red color has been formed to the desired film thickness, the substrate is transported again to form the light-emitting layer 617*b* of green color. The order of working steps to form the light-emitting layers 617*b* of respective colors of red, green and blue are arbitrary. In addition, although the second liquid droplet ejection step and the second drying step are repeated in this embodiment, these steps may be performed in one time each.

Figure 13:
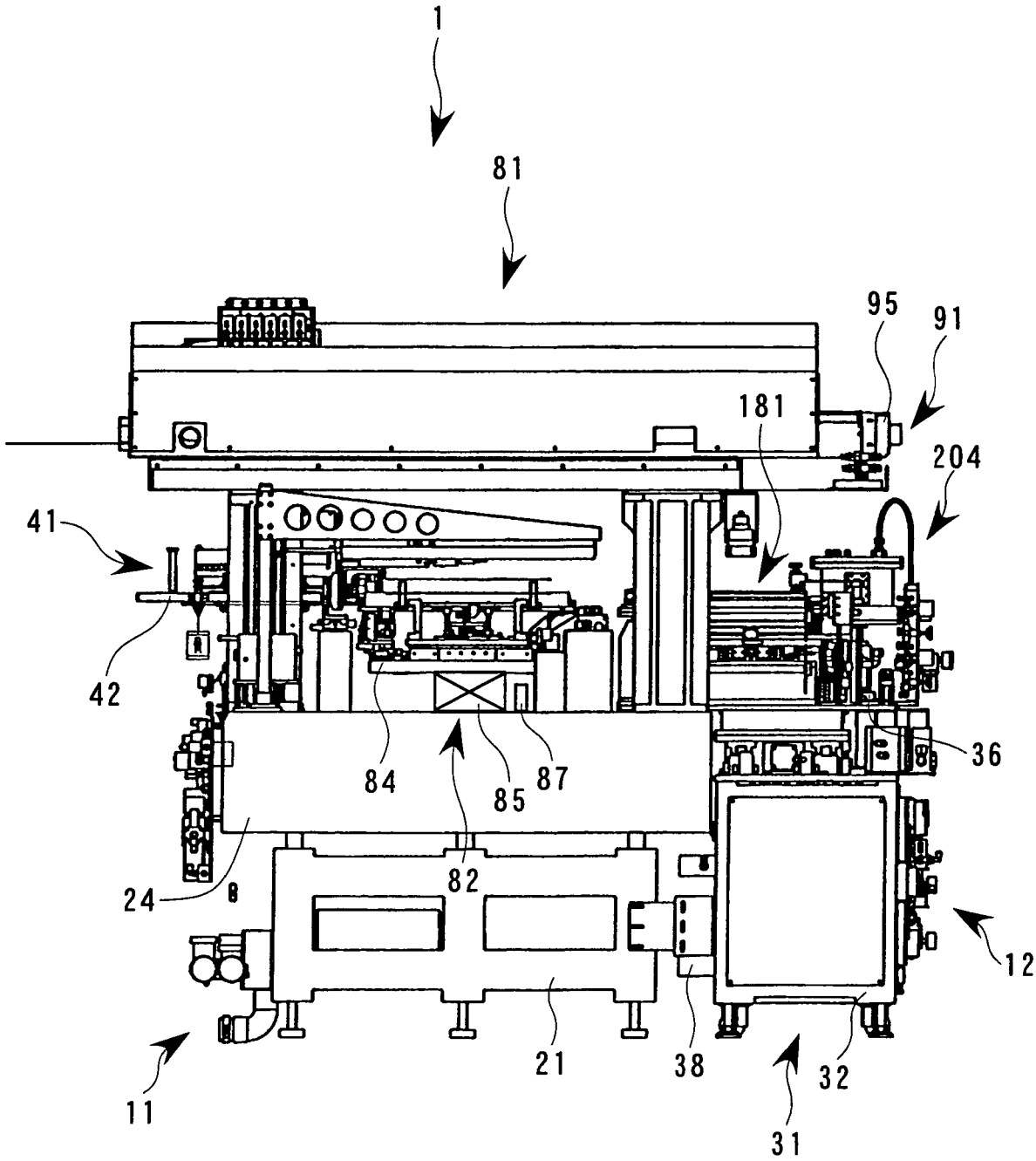
FIGS. 13 is a front view of the function liquid droplet ejection apparatus according to this invention.
Figure 14:
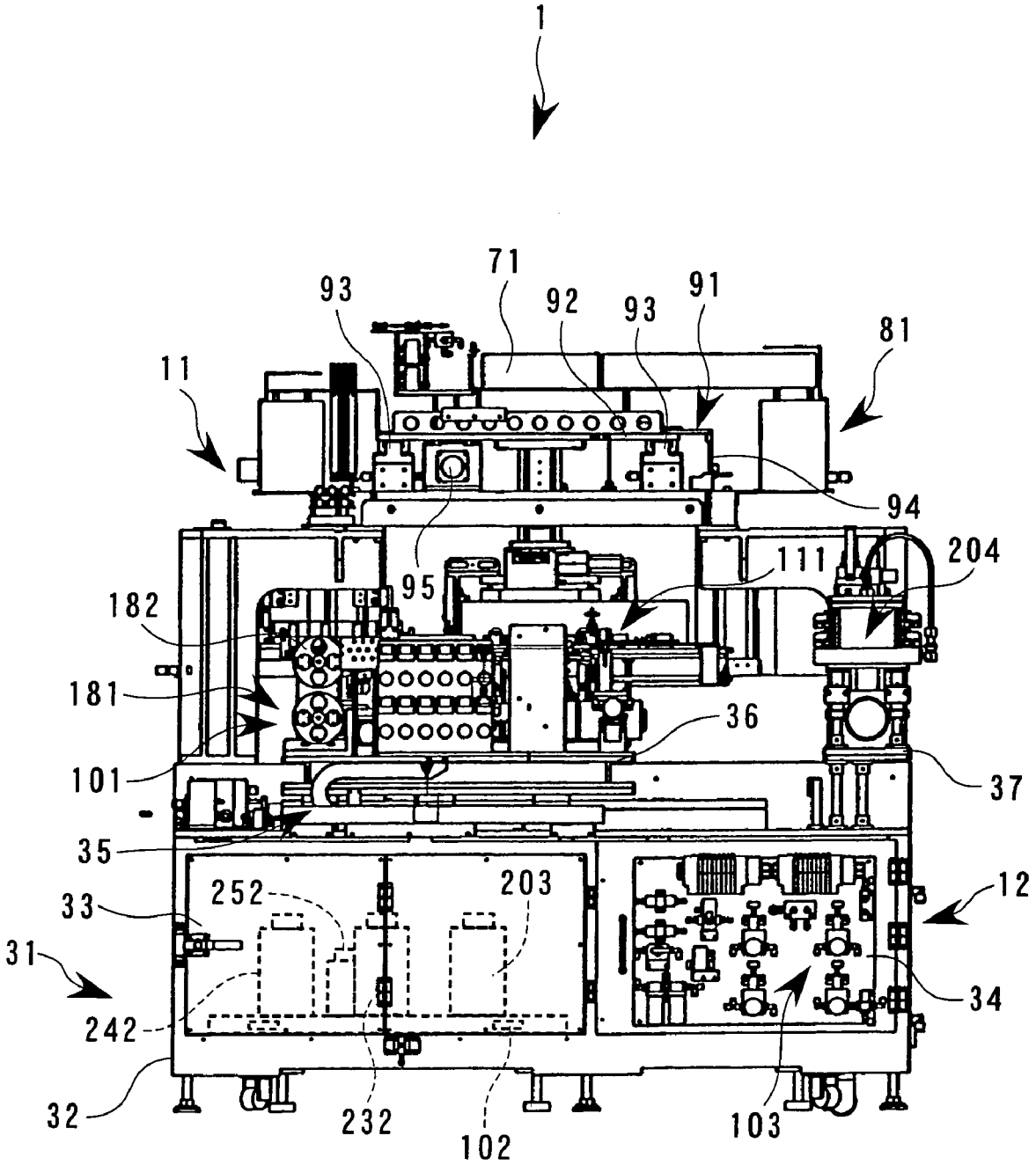
FIG. 14 is a right side view of the function liquid droplet ejection apparatus according to this invention.

With the above conditions as a prerequisite, a description will now be made about the function liquid droplet ejection apparatus which forms the essential part of this invention. FIG. 12 is a perspective view of the function liquid droplet ejection apparatus. FIG. 13 is a front view thereof, and FIG. 14 is a side view thereof. The liquid droplet ejection apparatus 1 is to eject the function liquid containing therein a function material such as a hole injection/transport layer material, a light-emitting layer forming material, or the like, toward a predetermined position of a substrate W which is set in position in the liquid droplet ejection apparatus 1.

As shown in FIG. 12, the liquid droplet ejection apparatus 1 is made up of: an ejection apparatus 11 which has a function liquid droplet ejection head 51 (see, e.g., FIG. 15) and ejects the function liquid; and auxiliary pieces of equipment 12 which are disposed integral with the ejection apparatus 11. The auxiliary pieces of equipment 12 include: a function liquid supply/recovery means 102 for supplying the ejection apparatus 11 with the function liquid and also for recovering the function liquid which is not required any more; air supply means 103 which supplies each of the constituting elements with compressed air for driving and controlling purposes; maintenance means 101 (FIG. 14) which is used for maintenance of the function liquid droplet ejection head 51 of the ejection apparatus 11 (FIG. 14); and control means (not illustrated) which controls each of the means in the ejection apparatus 11 and the auxiliary pieces of equipment 12.

As shown in FIGS. 12 and 13, the ejection apparatus 11 has a supporting base 21 which is made up of: an angular member 21 formed into a rectangle; and supporting legs with a plurality of (9) adjusting bolts which are disposed on a lower portion of the supporting base 21. A stone surface table 24 is fixed to an upper portion of the supporting base 21 by means of fixing members. The stone surface table 24 is to support the X/Y moving mechanism 81 (to be described hereinafter) which moves the substrate W and the function liquid droplet ejection head 51 at a high accuracy in a manner not to give rise to errors in point of accuracy (especially in point of degree of flatness) due to circumferential conditions, vibrations, or the like, and is made of a solid stone which is rectangular in plan view.

As shown in FIGS. 12 and 14, in the auxiliary pieces of equipment 12, each of the above-described means is mounted on a common machine base 31 which is made up of: a cabinet style of machine base main body 32 having formed therein, through a partition wall, two containing chambers 33, 34 which are large and small in size, respectively; a moving table 35 which is mounted on the machine base main body 32; a common base 36 which is fixed to the top of the moving table 35; and a tank base 37 which is disposed on the machine base main body 32 in an end position away from the moving table 35. The common base 36 has mounted thereon a maintenance means 101, the tank base 37 has mounted thereon a liquid supply tank 204 of the function liquid supply/recovery means 102, the smaller containing chamber 34 in the machine base main body 32 contains therein the main portions of the air supply means 103, and the larger containing chamber 33 contains therein tanks for the function liquid supply/recovery means 102.

The machine base main body 32 has on the lower surface thereof six supporting legs with adjusting bolts and four casters and, on the side of the ejection apparatus 11, a pair of connecting brackets 38 for connection to the supporting base 21 of the ejection apparatus 11. According to this arrangement, the ejection apparatus 11 and the auxiliary pieces of equipment 12 (common machine base 31) are integrated together such that the auxiliary pieces of equipment 12 can still be separated and moved where necessary.

Although not illustrated, there are further disposed a substrate recognition camera for recognizing the position of the substrate W, a head unit recognition camera for recognizing the position of a head unit 41 (to be described hereinafter) of the ejection apparatus 11, and auxiliary devices such as various indicators, or the like. They are all controlled by the control means.

A brief description will now be made about a series of operations of the liquid droplet ejection apparatus 1. In preparation for the ejection of the function liquid, the positional correction of the head unit 41 is performed by the head recognition camera and thereafter the positional correction of the substrate W is made. Then, the substrate W is moved back and forth in the main scanning direction (X-axis direction) and also a plurality of function liquid droplet ejection heads 51 are driven to thereby perform the selective ejection of the function liquid toward (or on) the substrate W. After moving the substrate W backward (i.e., returning the substrate W), the head unit 41 is moved in the sub-scanning direction (Y-axis direction). The back and forth movement of the substrate W in the main scanning direction and the driving of the function liquid droplet ejection head 51 are performed again. In this embodiment, the substrate W is moved in the main scanning direction relative to the head unit 41. It may also be so arranged that the head unit 41 is moved in the main scanning direction. Or else, it may further be so arranged that the head unit 41 is fixed (stationary) and that the substrate W is moved in the main scanning direction and in the sub-scanning direction.

A description will now be made in sequence about the maintenance means 101 for the ejection apparatus 11 and the auxiliary pieces of equipment 12, function liquid supply/recovery means 102, and control means which are particularly relevant to this invention. The ejection apparatus 11 is to eject the function liquid toward a predetermined position of the substrate W and is made up of: the head unit 41 having mounted thereon the function liquid ejection head 51; a main carriage 71 for supporting the head unit 41; and an X/Y moving mechanism 81 which is supported on the stone surface table 24 and which performs the main scanning of the substrate W and the sub-scanning of the head unit 41 through the main carriage 71.

Figure 15:
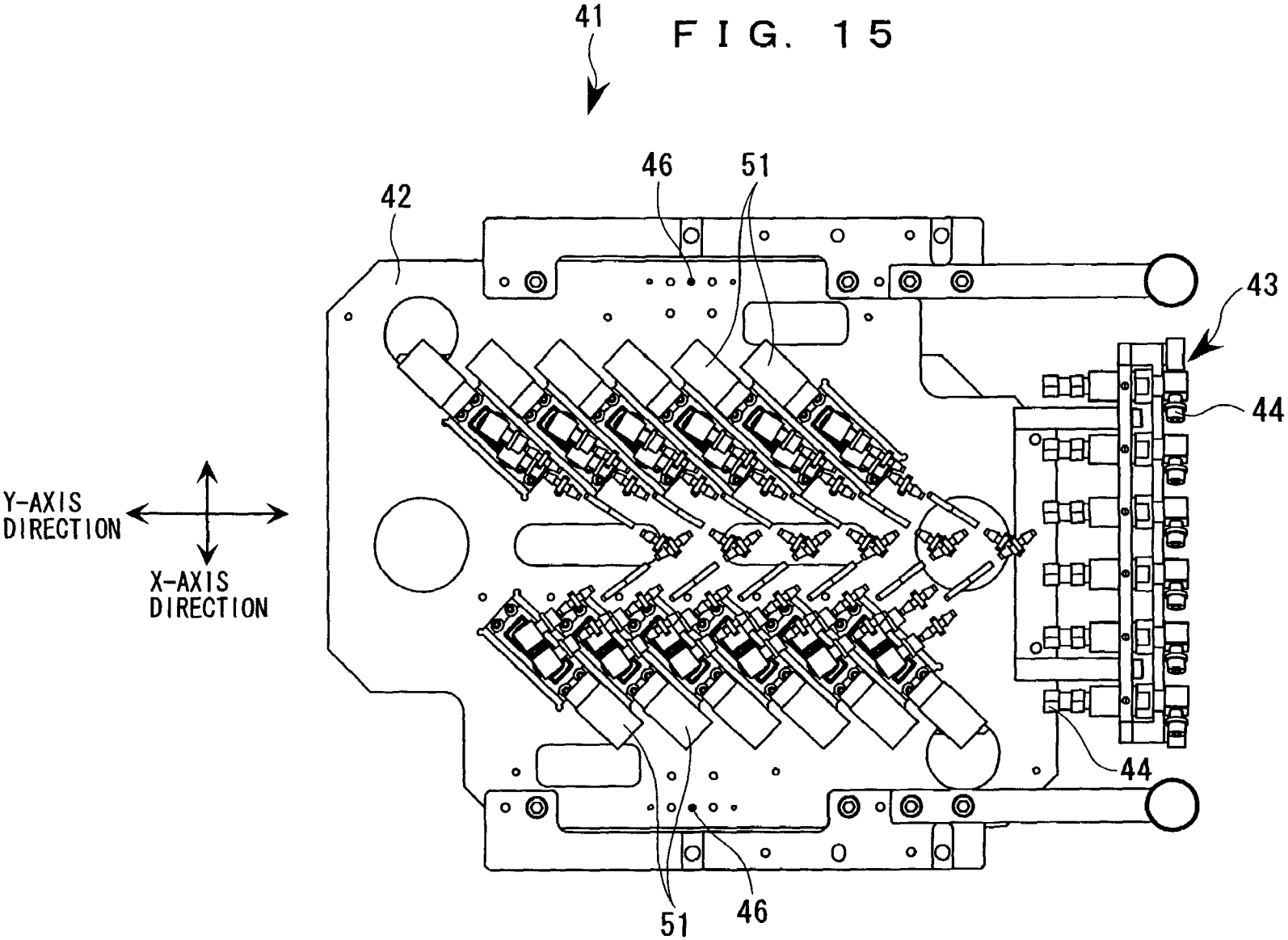
FIG. 15 is a plan view of a head unit.
Figure 16:
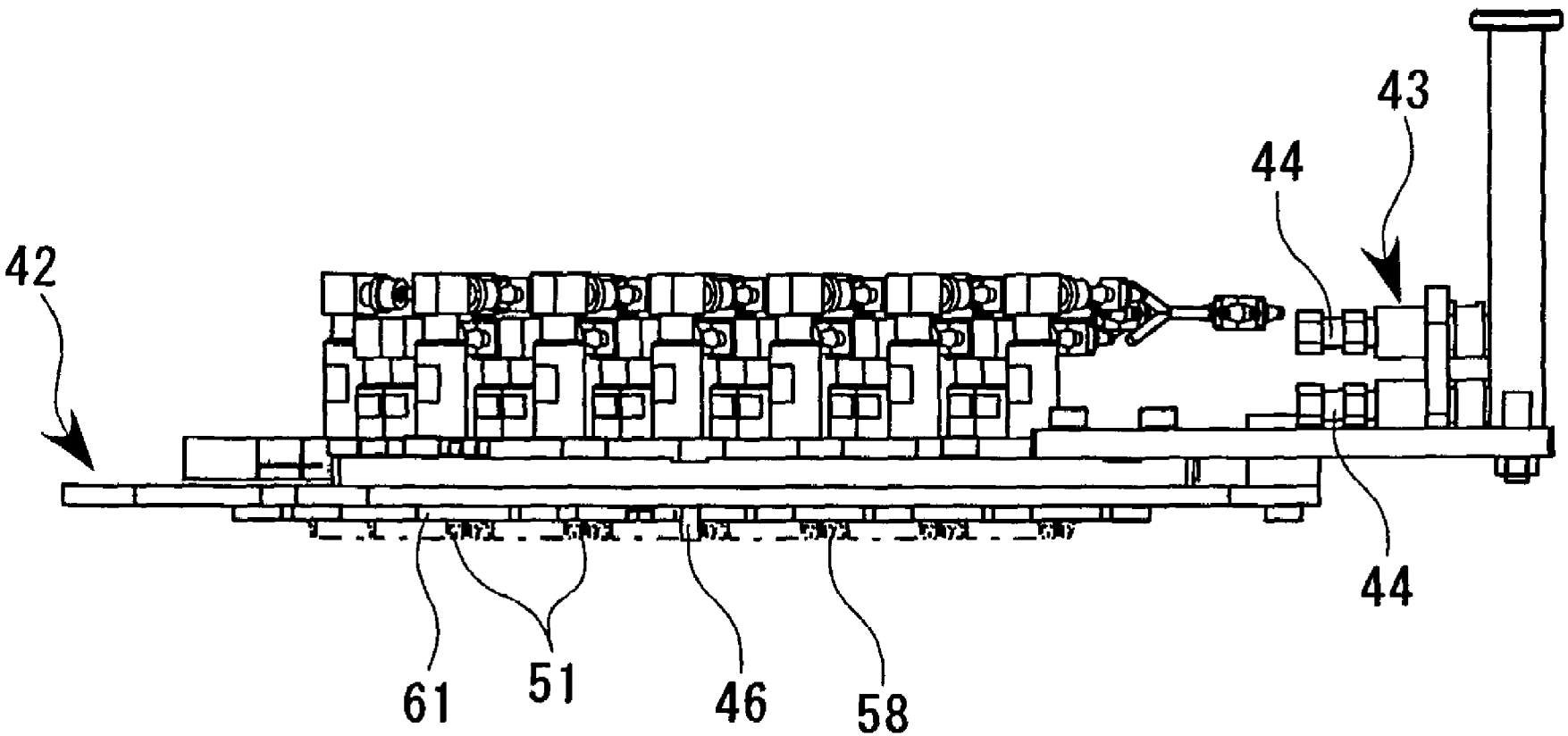
FIG. 16 is a front view of the head unit.

As shown in FIGS. 15 and 16, the head unit 41 is made up of: the sub-carriage 42; a plurality of (twelve) function liquid droplet ejection heads 51 having nozzle surfaces (to be described hereinafter) projected downwards from the sub-carriage 42; and a plurality of (twelve) head holding members 61 for independently mounting each of the function liquid droplet ejection heads 51 on the sub-carriage 42. The twelve function liquid droplet ejection heads 51 are divided into two, each having six, and are disposed at a given angle so as to secure a sufficient coating density of the function liquid relative to the substrate W. In addition, the two groups of function liquid droplet ejection heads 51 each containing six are disposed with a positional deviation between the two groups relative to the sub-scanning direction. It is thus so arranged that all of the ejection nozzles 59 (to be described hereinafter) of the twelve function liquid droplet ejection heads 51 are continuous (partly overlapped) in the sub-scanning direction. However, if the function liquid droplet ejection head 51 is arranged to be exclusively used for a particular substrates W, the function liquid droplet ejection heads 51 need not be set at an angle.

The sub-carriage 42 is provided with a pipe joint 43 which connects each of the function liquid droplet ejection heads 51 and the liquid supply tank 204 of the liquid supply/recovery means 102. The pipe joint 43 is connected at its one end to a head-side piping material from a piping adaptor 45 which is connected to each of the function liquid droplet ejection heads 51, and is provided, at the opposite end thereof, with twelve sockets 44 for connecting the apparatus-side piping material from the liquid supply tank 204. The sub-carriage 42 is recognized by the head recognition camera and has a pair of reference pins 46 which serve as a reference at the time of positioning the head unit 41.

Figure 17A:
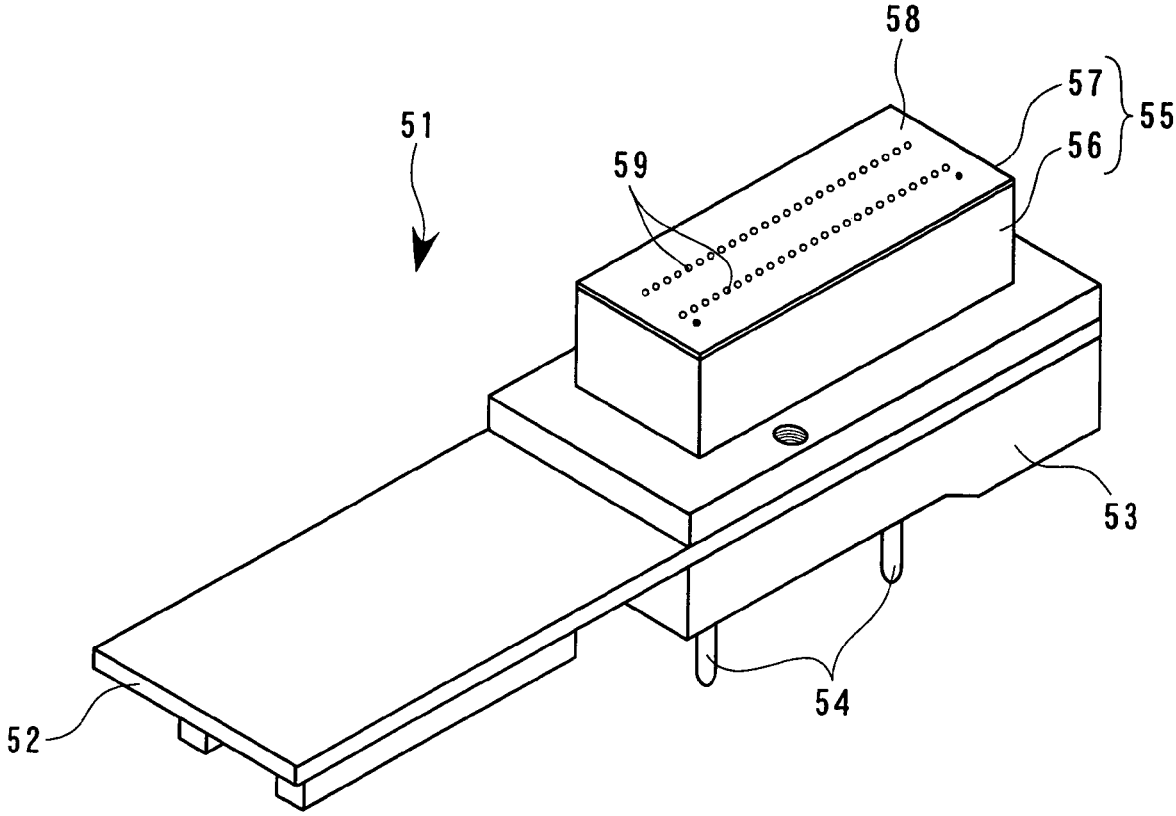
FIG. 17A is a perspective view of a function liquid droplet ejection head.
Figure 17B:
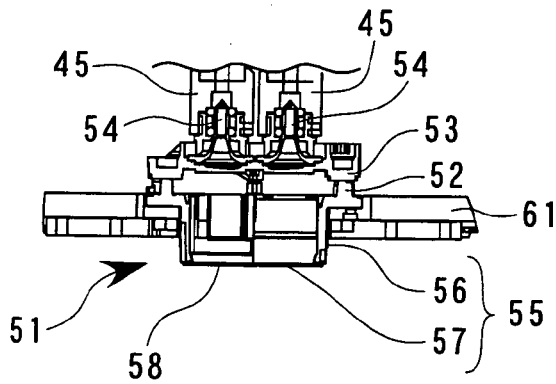
FIG. 17B is a sectional view showing the state in which the function liquid droplet ejection head is mounted on a piping adapter.

FIGS. 17A is a perspective view of the function liquid droplet ejection head and FIG. 17B is a sectional view around the function liquid droplet ejection head. As shown in FIGS. 17A and 17B, the function liquid droplet ejection head 51 is a so-called dual-line type. The head substrate 52 is provided with: a function liquid introduction part 53 which has dual connection needles 54 to be connected to the piping adaptor 45; and a head main body 55 which is constituted by a dual pump part 56 and a nozzle forming plate 57 which has a nozzle surface 58 having formed therein two rows of ejection nozzles 59. Inside the head main body 55 is formed a in-head flow passage which is filled with the function liquid. By the function of the pump part 56 the function liquid droplet is ejected from the ejection nozzle 59.

The main carriage 71 has a rectangular opening for loosely fitting therethrough the head unit 41, thereby fixing in position the head unit 41. The main carriage 71 has disposed therein the substrate recognition camera for recognizing the substrate W.

The X/Y moving mechanism 81 is provided with an X-axis table 82 which is fixed in a state in which the axial line thereof coincides with the center line along the longer side of the stone surface table 24, and a Y-axis table 91 whose axial line is made to coincide with the short side of the stone surface table 24.

The X-axis table 82 is made up of: a suction table 83 which sucks the substrate W in position by air suction; a Θ table 84 which supports the suction table 83; an X-axis air slider 85 which supports the Θ table 84 in a manner to be slidable in the X-axis direction; an X-axis linear motor (not illustrated) which moves the substrate W on the suction table 83 in the X-axis direction through the Θ table 84; and an X-axis liner scale 87 which is disposed in parallel with the X-axis air slider 85. The main scanning of the function liquid droplet ejection head 51 is made by the back-and-forth movement of the suction table 83 and the Θ table 84 in the X-axis direction by the driving of the X-axis linear motor with the X-axis air slider 85 serving as a guide.

The Y-axis table 91 is made up of: a bridge plate 92 which suspends the main carriage 71; a Y-axis slider 93 which supports the bridge plate 92 on both sides thereof in a manner to be slidable in the Y-axis direction; a Y-axis linear scale 94 which is disposed in parallel with the Y-axis slider 93; a Y-axis ball screw 95 which causes the bridge plate 92 to move in the Y-axis direction by guiding a pair of Y-axis sliders 93; and a Y-axis motor (not illustrated) which rotates the Y-axis ball screw 95 in one direction and in the opposite direction. On both sides of the pair of the Y-axis slider 93, there are disposed a pair of flexible Y-axis cable supports in a state in which the cables are housed inside boxes (not illustrated). The Y-axis motor is constituted by a servomotor. When the Y-axis motor rotates in one direction and in the opposite direction, the bridge plate 92 which is engaged in a screwed manner with the Y-axis screw 95 is moved in the Y-axis direction with the pair of the Y-axis sliders 93 serving as guides. In other words, as a result of movement of the bridge plate 92, the main carriage 71 (head unit 41) moves back and forth in the Y-axis direction, whereby the sub-scanning of the function liquid droplet ejection head 51 is performed.

A description will now be made about the maintenance means 101 of the auxiliary pieces of equipment 12. The maintenance means 101 is to maintain the function liquid droplet ejection head 51 so that the function liquid droplet ejection head 51 can eject the function liquid in an adequate manner. It is made up of a cleaning unit 111, a wiping unit 181, and a flushing unit 191.

The cleaning unit 111 of this embodiment has: a suction function to suck the function liquid from the function liquid droplet ejection head 51 through a head cap 113 (to be described hereinafter); a moisture-retaining function to close (seal) the nozzle surface of the function liquid droplet ejection head 51 by the head cap 113; and a flushing box function to receive the false or waste ejection (flushing) from the function liquid droplet ejection head 51. The suction function is to suck the function liquid forcibly from the nozzle of the function liquid droplet ejection head 51. The sucking operation is performed mainly at the start of the operation of the apparatus in order to eliminate the nozzle clogging. Or else, the sucking operation is performed when the function liquid is initially filled into the function liquid supply system inclusive of the function liquid droplet ejection head 51. The moisture-retaining function is to prevent the function liquid from getting dried, by capping the function liquid droplet ejection head 51 (i.e., by closing the liquid droplet ejection head 51 with a cap) at the idling time of the apparatus or at the time of stopping the operation of the apparatus for transferring/transporting the substrate for a long period of time. The flushing box function is to receive the flushed (waste) liquid to be ejected not for imaging purpose but regularly at the time outside the imaging operation. The flushing to be performed during imaging is handled by the above-described flushing unit 191. The wiping unit 181 is to wipe out mainly by suction operation the function liquid that has been adhered to the nozzle surface.

Figure 18:
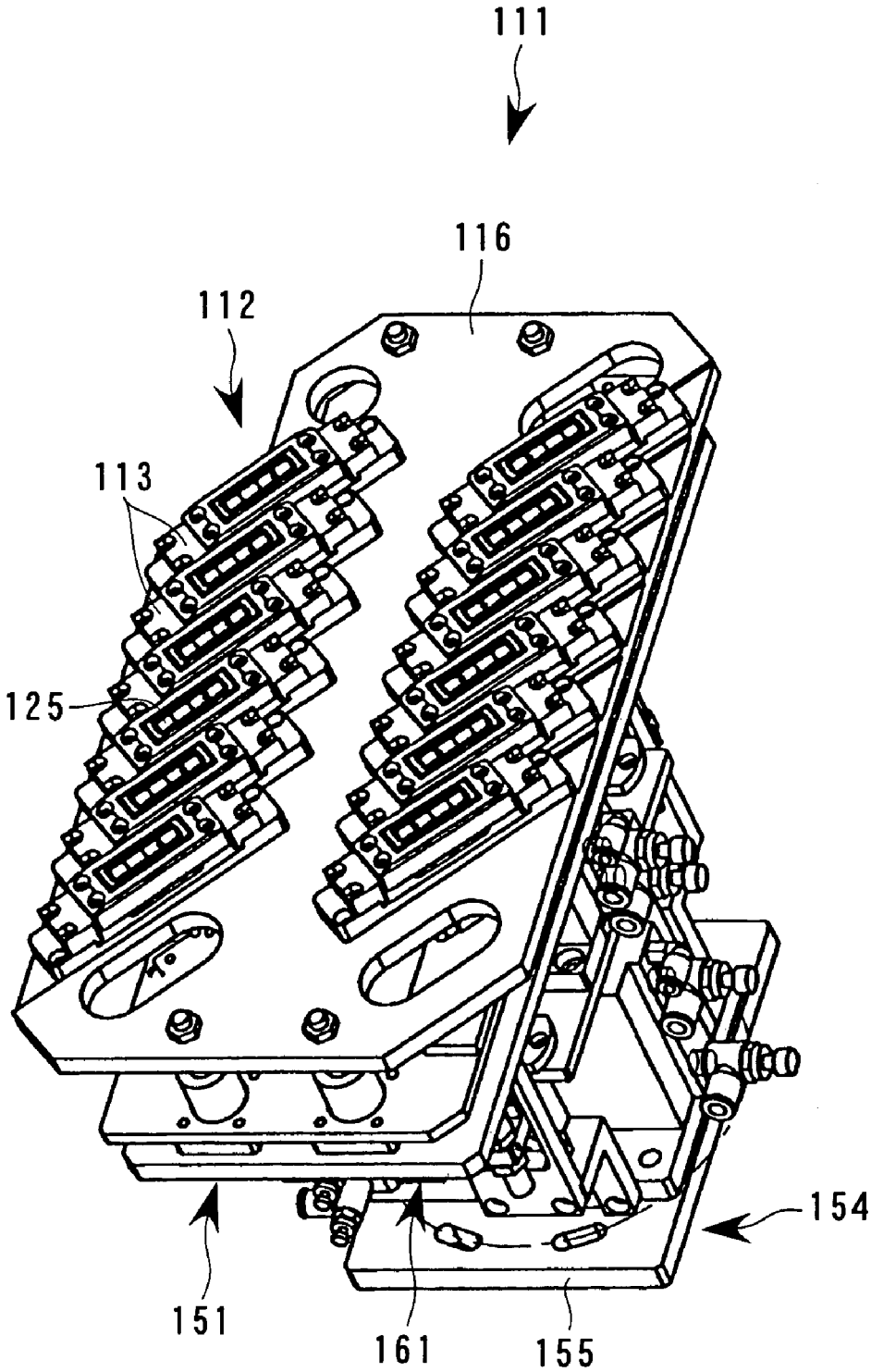
FIG. 18 is a perspective view of a maintenance unit.
Figure 19:
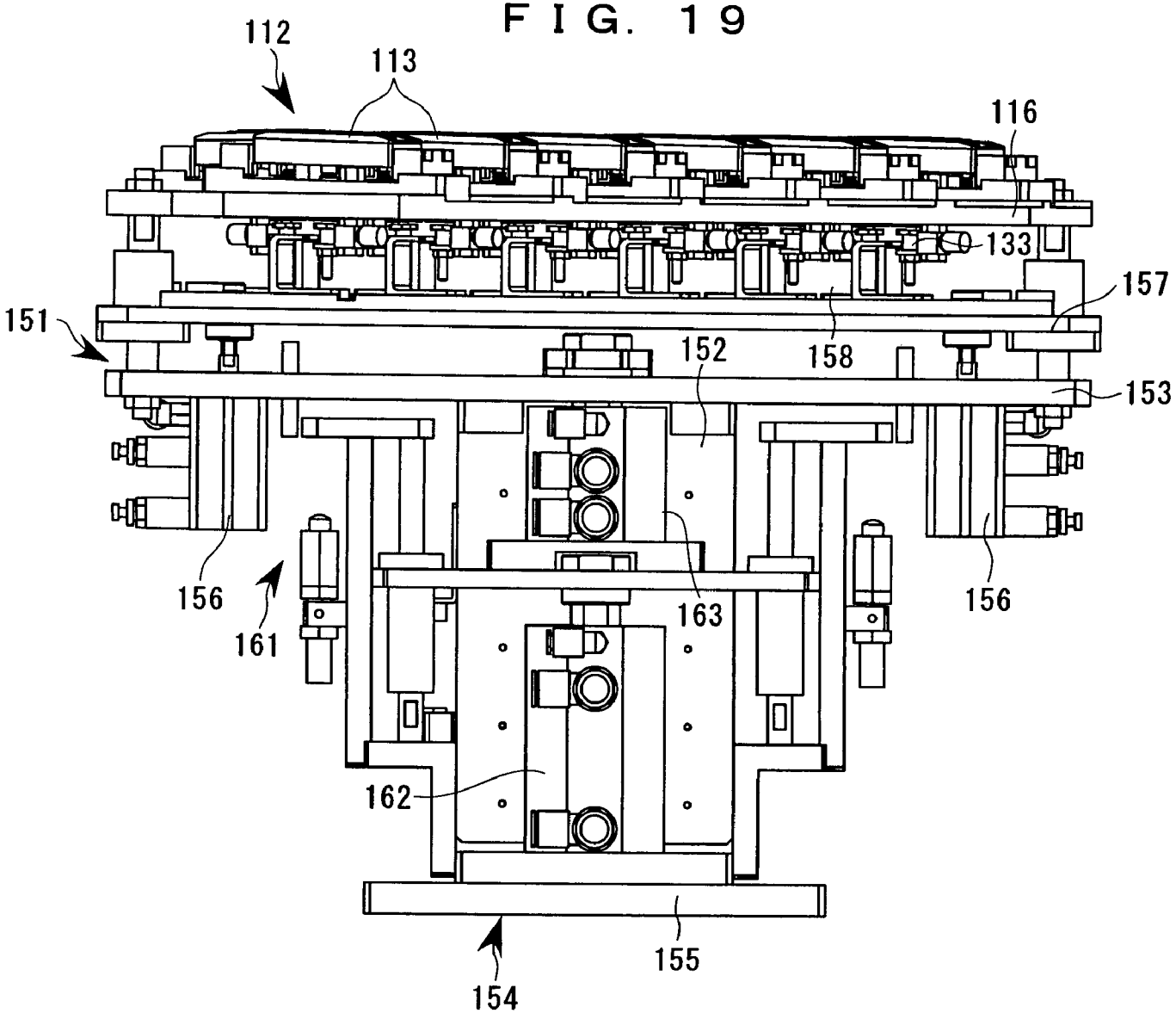
FIG. 19 is a front view of the maintenance unit.
Figure 25:
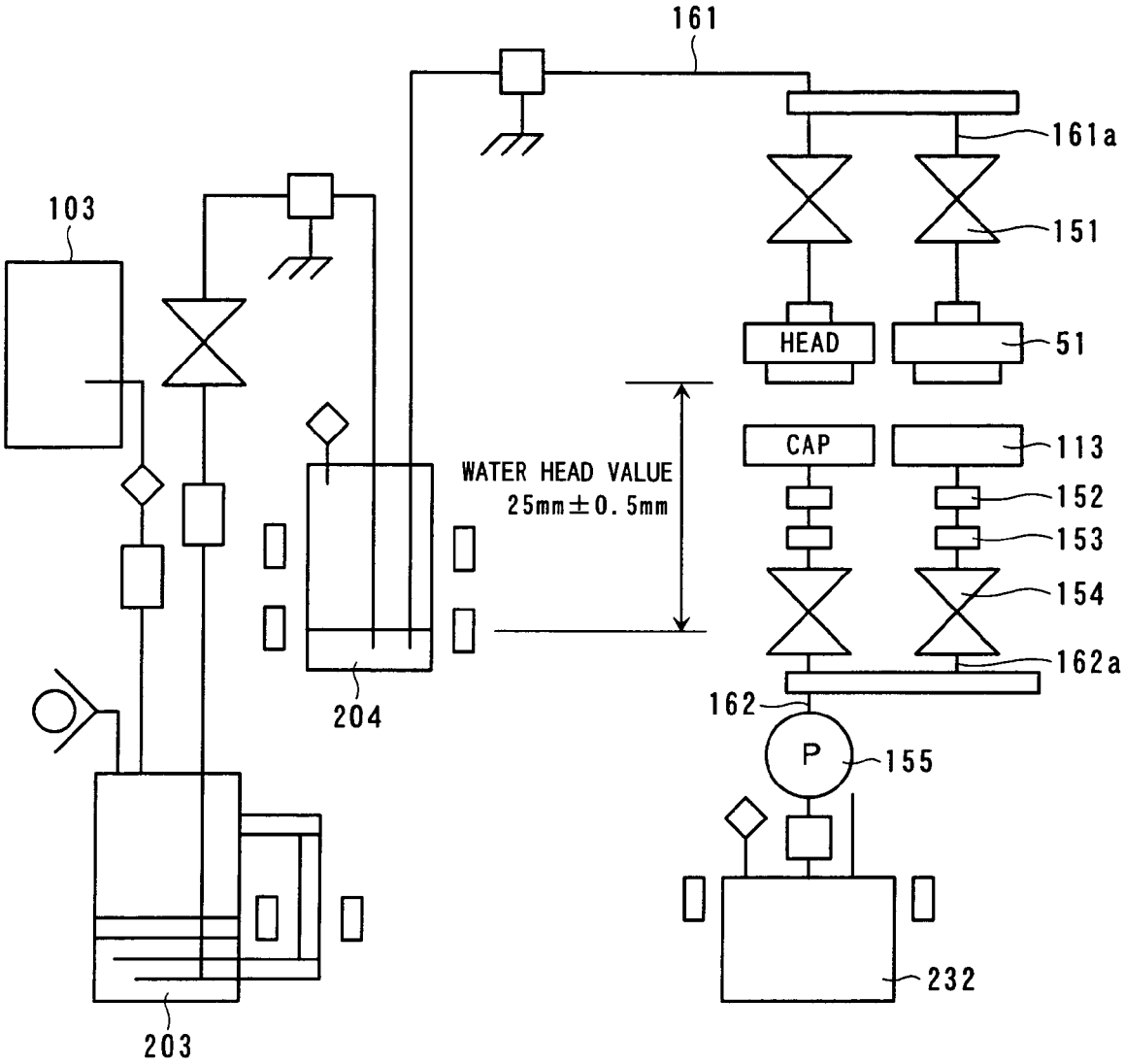
FIG. 25 is a schematic diagram of the function liquid droplet ejection head, a function liquid supply system to be connected thereto, and a cleaning unit.

With reference to FIGS. 18 and 19, a description will be made about the cleaning unit 111. FIG. 18 is a perspective view of the cleaning unit, and FIG. 19 is a sectional view thereof. The cleaning unit 111 is to perform the cleaning of the head unit 41 and is made up of: a cap unit 112 which has disposed on the base plate 116 twelve head caps 113 to correspond to the twelve function liquid droplet ejection heads 51; a supporting member 151 which supports the cap unit 112; and an elevating mechanism 161 which moves up and down the cap unit 112 through the supporting member 151. It is thus so arranged that each of the head caps 113 can be adhered to the nozzle surface of each of the function liquid droplet ejection heads 51. In addition, each of the head caps 113 is connected to a branch suction passage 162*a* (FIG. 25) which is branched into twelve through a suction passage 162 connected to the suction pump 155. Each of the suction branch passages 162*a* is provided with a liquid sensor 152, a pressure sensor 153 and a suction gate valve 154 in the order as described as seen from the side of the head cap 113.

Figure 21:
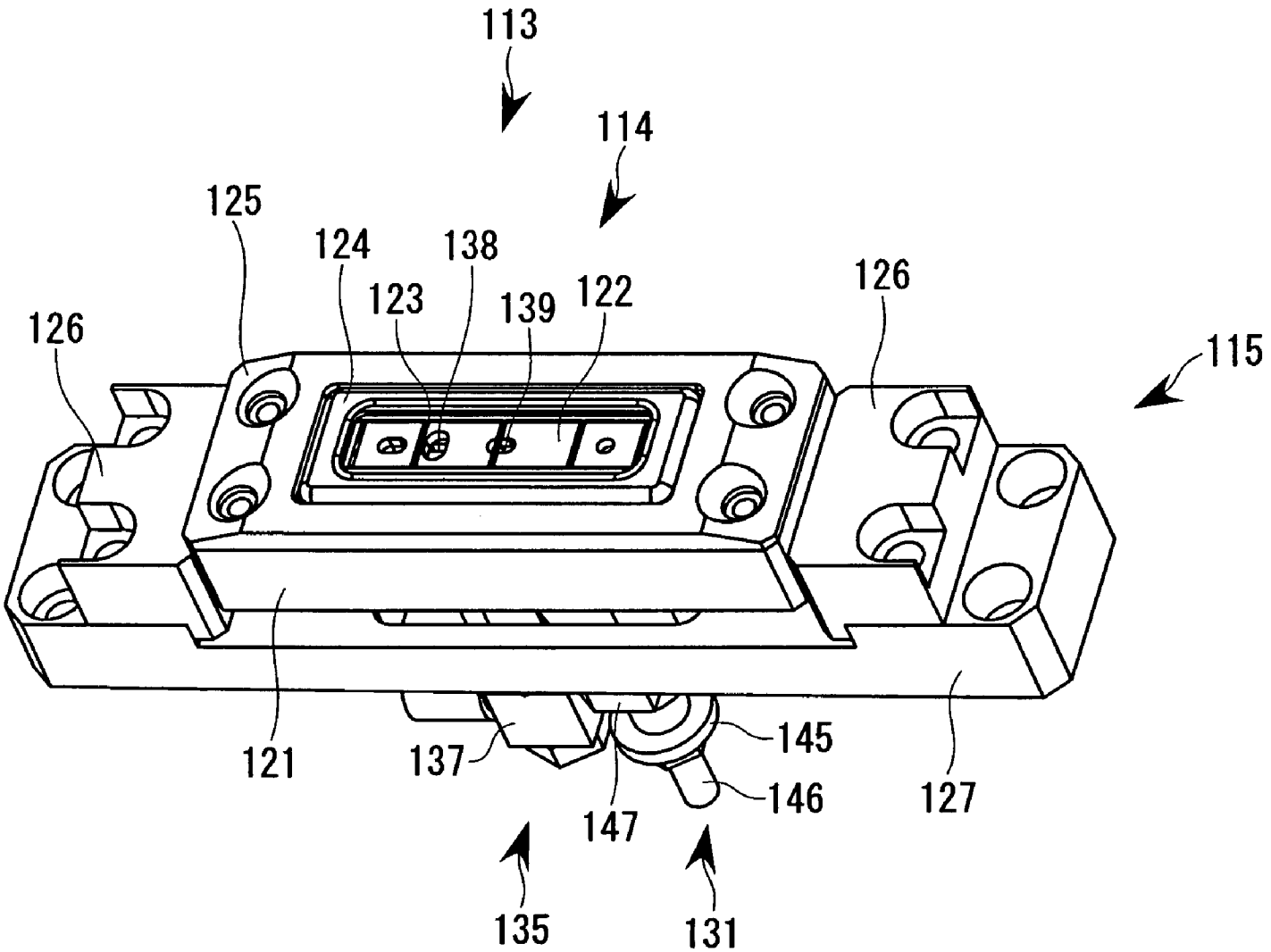
FIG. 21 is an overall perspective view of a head cap.
Figure 22:
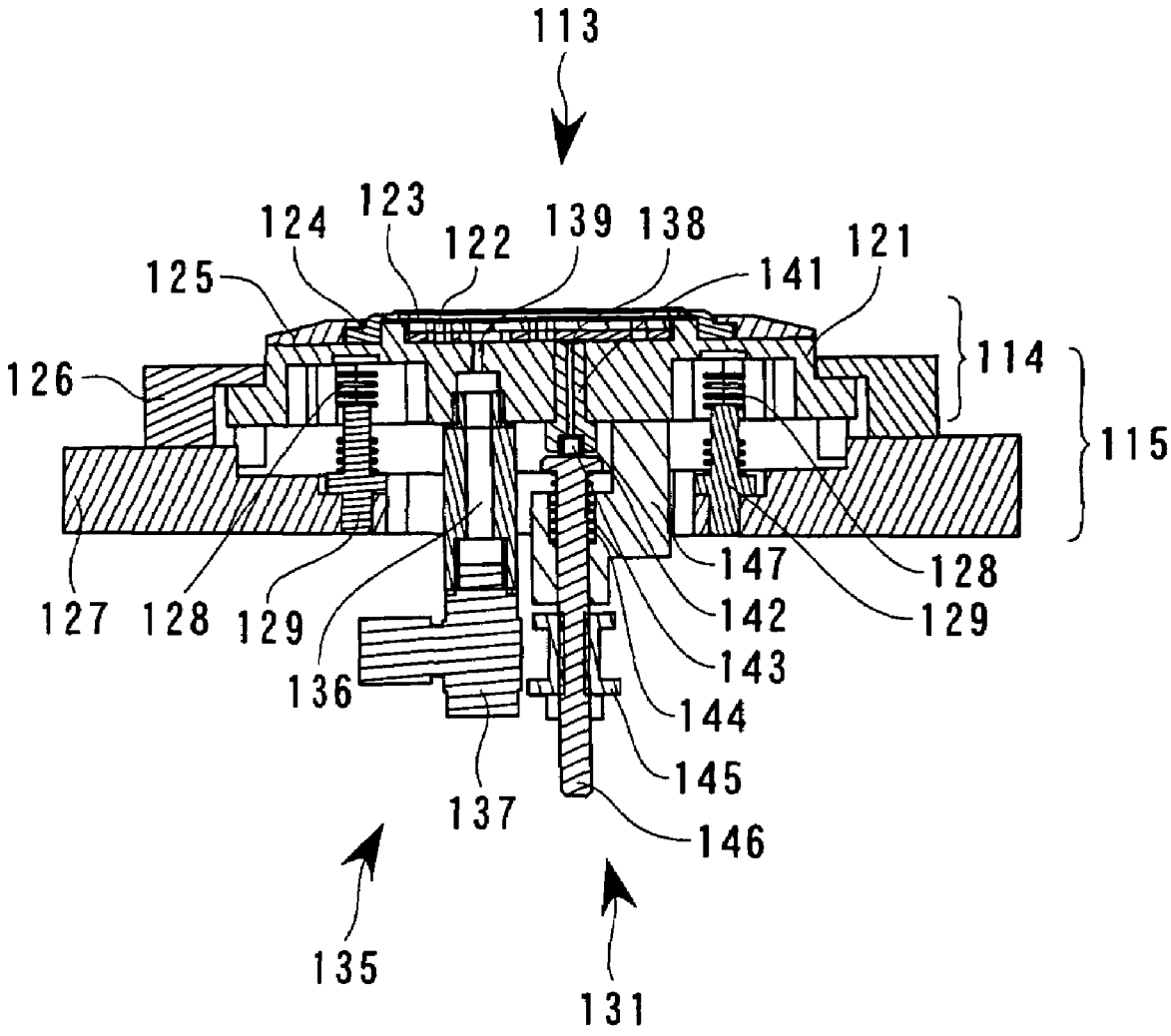
FIG. 22 is a sectional view of the head cap.

As shown in FIGS. 21 and 22, the head cap 113 is made up of: a cap main body 114 having a sealing member 124 which is adhered to the nozzle surface 58 of the function liquid droplet ejection head 51; and a cap holder 115 which supports the cap main body 114. The cap main body 114 is supported on the cap holder 115 in a state in which it is urged by a pair of springs 128, 128. It is thus so arranged that, when the head cap 113 is closely or intimately adhered to the nozzle surface 58 of the function liquid droplet ejection head 51, the cap main body 114 sinks slightly into the cap holder 115. The head cap 113 is arranged to seal the nozzle surface 58 of the function liquid droplet ejection head 51 to thereby perform suction operation at the time of performing the cleaning operation.

Figure 20:
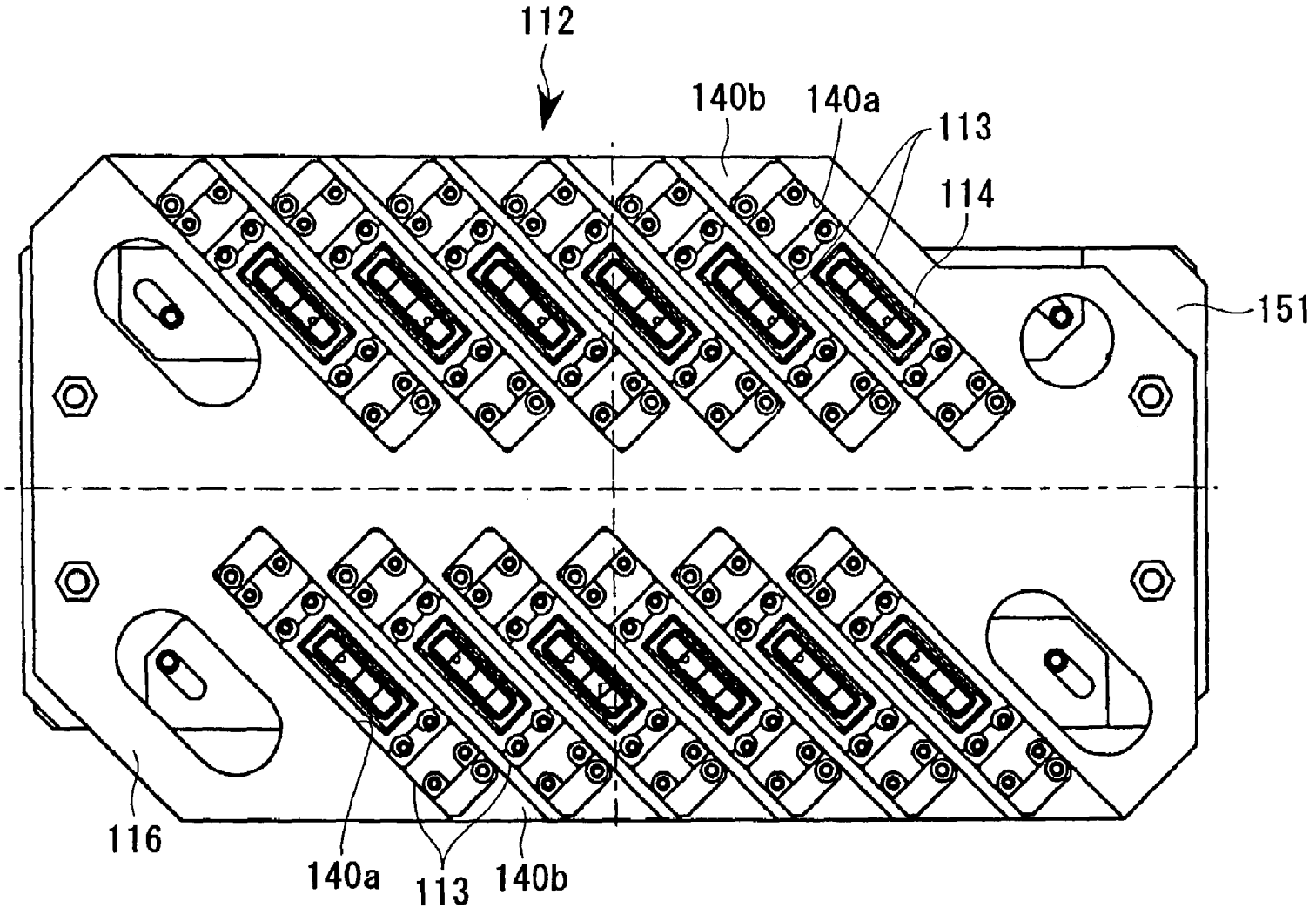
FIG. 20 is a plan view of the maintenance unit.

The base plate 116 has fixed thereto twelve head caps 113 which are inclined in the same direction as that of the twelve function liquid droplet ejection heads 51 of the head unit 41. On the surface which lies opposite to the head unit 41, there are formed twelve mounting openings 140*a* so as to face the twelve head caps 113 and twelve shallow grooves 140*b* so as to include the mounting openings 140*a*. Each of the head caps 113 is inserted at its lower portion into the mounting opening 140*a* and, in a state of being positioned in the shallow groove 140*b*, is fixed by screwing to the shallow groove 140*b* (see FIG. 20).

The supporting member 151 is made up of: a supporting member main body 152 having a supporting plate which supports the cap unit 112 at an upper end; and a stand which supports the supporting member main body 152 in a manner to be slidable in the vertical direction. On the lower surface of the longitudinal both sides of the supporting plate 153, there are fixed a pair of air cylinders 156. An operating plate 157 which is moved up and down by the air cylinders 156 is disposed. On this operating plate 157 there is mounted a hook 158 which is engaged with the operating part of the vent (relief) valve 131 in each of the head caps 113.

The elevating mechanism 161 has: a lower-stage lifting cylinder 162 which is made up of the air cylinder 156 vertically disposed on the base portion 155 of the stand 154; and an upper-stage lifting cylinder 163 which is made up of the air cylinder 156 vertically disposed on a plate to be moved up and down by the cylinder 162. By the selective operation of these lifting cylinders 162, 163, the lifted position of the cap unit 112 can be switched between a first position in which the sealing member 124 of the head cap 113 is closely adhered to the nozzle surface 58 of the function liquid droplet ejection head 51 and a second position in which a small clearance is secured between the sealing member 124 of the head cap 113 and the nozzle surface 58 of the liquid droplet ejection head 51.

As described above, the cap 113 which performs the suction operation by coming into close contact with the nozzle surface 58 of the function liquid droplet ejection head 51 is made up of a cap main body 114, and a cap holder 115. The head cap 113 has assembled therein: the pair of coil springs 128, 128 which urge the cap main body 114 upward (in the direction of close contact or adhesion); a connecting coupling 135 which is connected to the branch suction passage 162*a*; and the above-described vent valve 131.

Figure 23:
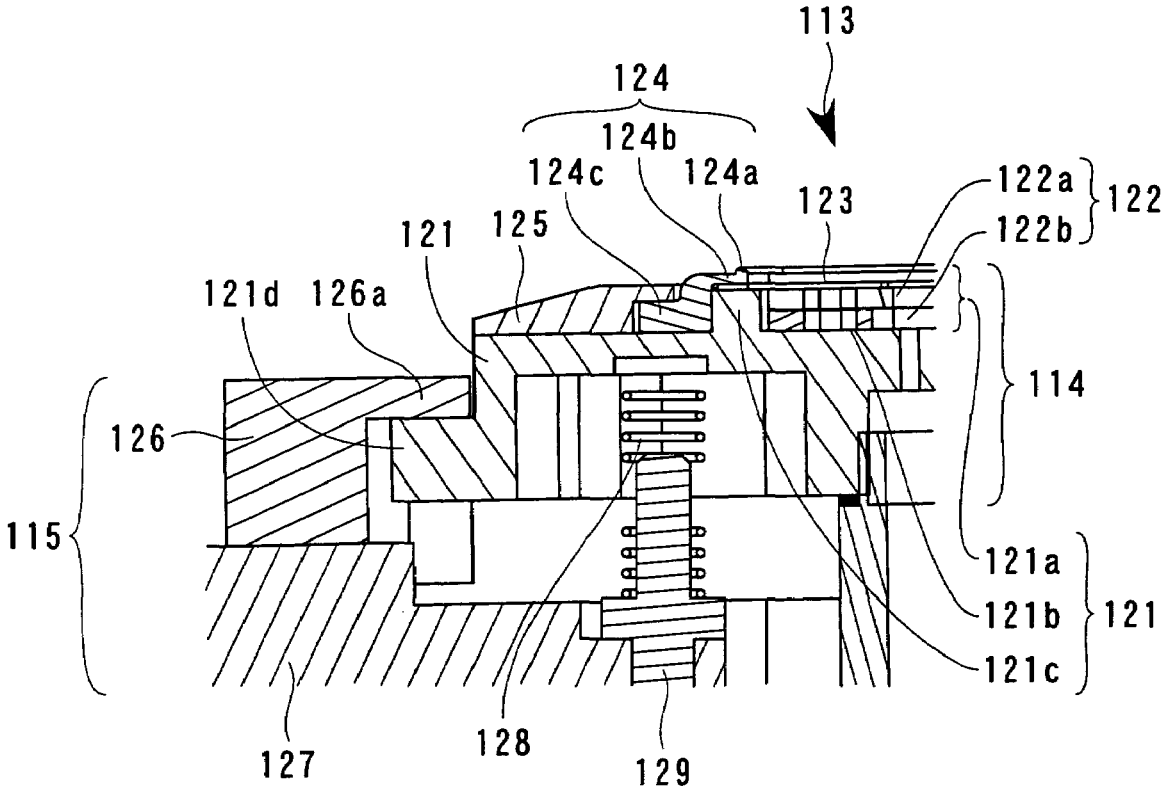
FIG. 23 is an enlarged partial sectional of the head cap.

As shown in FIGS. 21 through 23, the cap main body 114 is made up of: a cap base 121 which has formed on an upper surface thereof an absorbing material housing (or containing) part 121*a*; a function liquid absorbing material 122 which is filled in the absorbing material housing part 121*a*; an absorbing material urging (or pushing) member 123 which urges (or pushes) the function liquid absorbing material 122; a sealing member 124 which is disposed on an upper side of the absorbing material housing part 121*a*; and a seal fixing member 125 which fixes the sealing member 124 to the cap base 121. The cap main body 114 is formed into an oblong shape as a whole.

The cap base 121 as shown in FIGS. 21 through 23 is made of a corrosion resistant material such as stainless steel, or the like. The absorbing material housing part 121*a* is formed in a manner to project upward beyond the surface and has formed, on both longitudinal ends in the lower portion, a pair of leg pieces 121*d* which are engaged with the cap holder 115. The absorbing material housing part 121*a* is made up of: a recessed groove 121*b* which houses therein the function liquid absorbing material 122; and a loop-shaped peripheral portion 121*c* which defines the recessed groove 121*b* and projects beyond the cap base 121. At the bottom part of the recessed groove 121*b*, there are formed a suction port 139 which is in communication with the connecting coupling 135, and an atmosphere inlet port 138 which is in communication with the vent valve 131.

The function liquid absorbing material 122 is constituted by laminating two kinds of function liquid absorbing materials 122*a*, 122*b* of different materials, and a small hole is formed in a position facing the suction port 139 and the atmosphere inlet port 138, respectively. The function liquid absorbing material 122 may be constituted not only in two-layer construction but also in a single layer construction or a multi-layer construction. In addition, the function liquid absorbing material 122 shall preferably be made of polyvinyl alcohol (PVA) when used in the apparatus for manufacturing a color filter, and of polyethylene (PE) when used in the apparatus for manufacturing an organic EL.

The absorbing material urging member 123 is made by fabricating a stainless steel thin plate and is integrally made up of a rectangular frame-shaped part 123*a*, and a plurality of (three) lattice-shaped parts 123*b* which are disposed so as to cross the frame-shaped part 123*a*. In this case, the absorbing material urging member 123 is formed by punching a stainless steel plate of about 0.3 mm thick by means of a wire saw, or the like, so that the frame-shaped part 123*a* and the lattice-shaped part 123*b* are finished in as small a width as possible (about 0.3 mm). In particular, by forming the lattice-shaped part small in width, the function liquid can be prevented from remaining or staying on the upper surface of the lattice-shaped part 123*b*.

The absorbing material urging member 123 thus constituted is disposed, in a state in which the function liquid absorbing material 122 is pushed from the upper side, such that the peripheral portion, i.e., the frame-shaped part 123*a* is seated into the loop-shaped peripheral portion 121*c* of the absorbing material housing part 121*a*. Further, both the lattice-shaped part 123*b* in this state stands clear of both the above-described small holes so as to push the intermediate portion of the function liquid absorbing material 122. Accordingly, even if the function liquid absorbing material 122 gets swelled, it can be kept flat.

The sealing member 124 is made of rubber or resin and is formed into a crank-shape in cross section by: a loop-shaped projecting part 124*a* which encloses all the ejection nozzles 59 and comes into close contact with the nozzle surface 58; a loop-shaped urging part 124*b* which urges or pushes the absorbing material urging member 123; and a loop-shaped fixing part 124*c* which is fixed to the cap base 121. In other words, the loop-shaped urging part 124*b* is disposed in a manner to lie opposite to the loop-shaped peripheral portion 121*c* of the absorbing material housing part 121*a*, and the loop-shaped projecting part 124*a* is disposed right above the loop-shaped urging part 124*b*. According to this arrangement, the adhesive reaction force of the sealing member 124*a* (loop-shaped projection part 124*a*) which has been adhered to the nozzle surface 58 of the function liquid droplet ejection head 51 functions to sandwich the absorbing material urging member 123 between the sealing member 124 and the loop-shaped peripheral portion 121*c* of the absorbing material housing part 121*a*, whereby the absorbing material urging member 123 can be stably held.

The seal fixing member 125 is made of a stainless steel, or the like, and is formed into a loop-shaped rectangle which is substantially similar to the contour of the upper surface of the cap base 121. The peripheral portion on the upper surface thereof is chamfered so as to be inclined. The inner periphery of the seal fixing member 125 urges or pushes the loop-shaped fixing part 124*c* of the sealing member 124. The seal fixing member 125 is fixed by screwing to the cap base 121 in this state.

Figure 24:
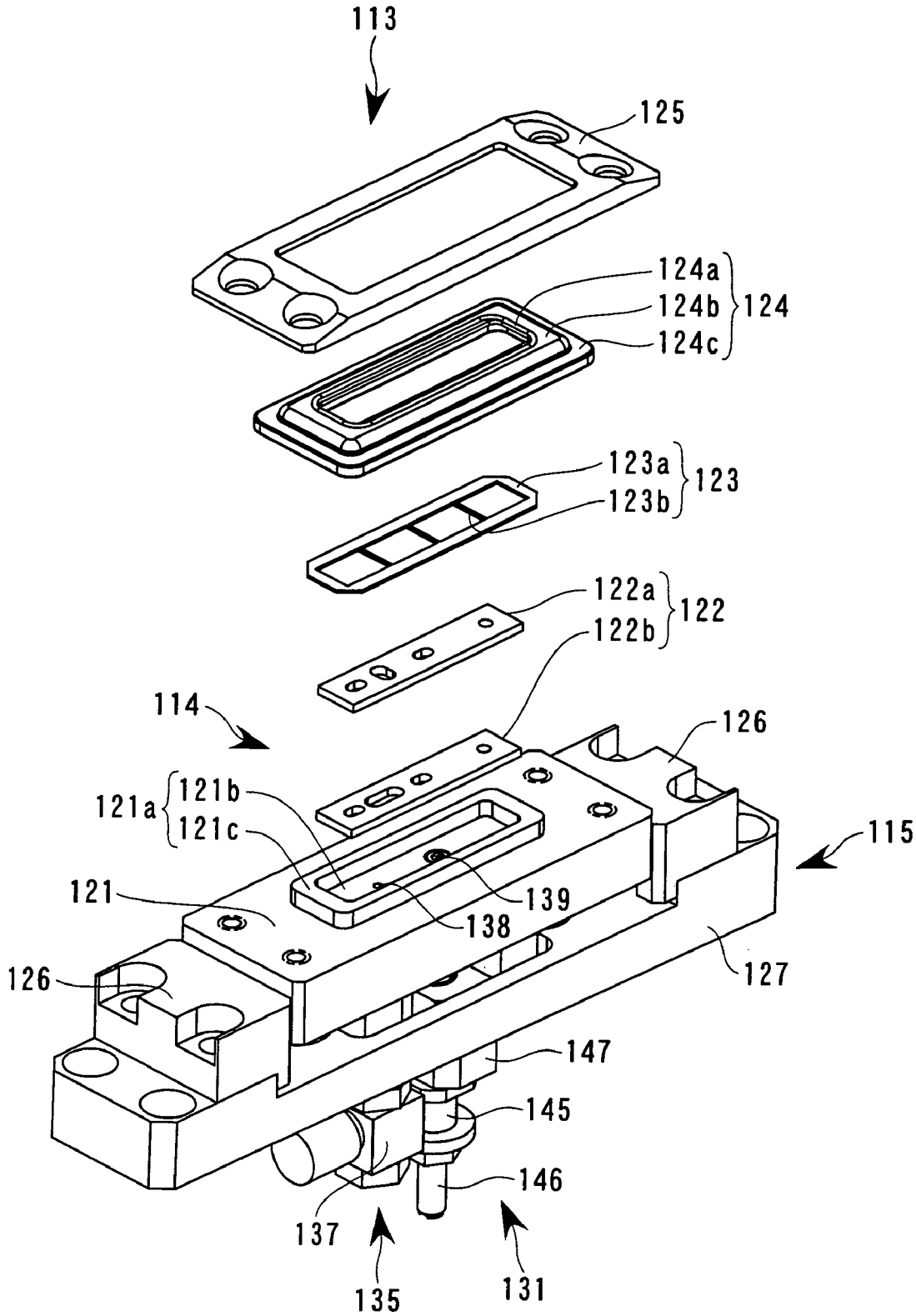
FIG. 24 is an exploded perspective view of the head cap.

A description will now be made about the assembling procedure of the cap main body 114 with reference to FIG. 24. After laying the absorbing material housing part 121*a* with the function liquid absorbing material 122, the absorbing material urging member 123 is seated onto the loop-shaped peripheral portion 121*c* of the absorbing material housing part 121*a* in a manner to push the function liquid absorbing material 122. Then, the sealing member 124 is mounted by pushing the peripheral portion of the absorbing material urging member 123 by means of the loop-shaped urging part 124*b*. Finally, the loop-shaped fixing part of this sealing member 124 is urged by the seal fixing member 125 toward the cap base 121 and, in this state, the seal fixing member 125 is fixed by screwing.

The cap main body 114 has a construction in which the function liquid absorbing material 122, the absorbing material urging member 123, the sealing member 124, and the seal fixing member 125 are urged and fixed in the order as described above. Therefore, only by loosening or removing the screws of the seal fixing member 125, the cap main body 114 can be easily taken into pieces of the constituent elements, and is capable of assembling it again. As a result, replacement may independently be made only of the constituting element or elements that should really be replaced.

The cap main body 114 constituted as described above is urged or pushed upward by means of the pair of coil springs 128, 128 which are in abutment with longitudinal two positions at the lower surface of the cap main body 114 so as to be urged upward in a state in which the upper end thereof is restricted in position. In other words, the cap main body 114 is mounted so as to be slidable in the vertical direction (up and down) relative to the cap holder 115 and, in this state, the upper movable end is positionally restricted by the cap holder 115 at both leg piece parts 121*d* of the cap base 121.

The cap holder 115 formed of a stainless steel, or the like, is made up of: a rectangular holder main body 127; and a pair of position restriction blocks 126 which are screwed to an upper surface of longitudinal both ends of the holder main body 127. The holder main body 127 has in its central portion a connection opening facing the connecting coupling 135 and the vent valve 131, as well as a pair of pins 129, 129 for holding the pair of coil springs 128, 128 in position. The upper surface of the holder main body 127 is formed into an inclined surface which is slightly inclined in the longitudinal direction.

Each of the position restriction blocks 126 has formed on the side of the cap main body 114 an engaging groove 126*a* with which is engaged the leg piece part 121*d* of the cap base 121. The upper surface of the engaging groove 126*a* constitutes the position restriction surface of the cap main body 114 which is urged by the coil springs 128, 128, and both side surfaces constitute sliding guide surfaces of the cap main body 114. In other words, that upper part 126*a* of each of the position restriction blocks 126 which is on the side of the cap main body 114 forms the position restriction part for restricting the position.

Both the position restriction blocks 126 which are fixed to the upper surface of the holder main body 127 are slightly inclined to follow the inclination of the upper surface of the holder main body 127. Therefore, the cap main body 114 whose position is restricted by both the position restriction blocks 126 is held by the cap holder 115 at a slight inclination in a state of being urged by the pair of the coil springs 128, 128. Accordingly, when the head cap 113 is urged against the nozzle surface 58 of the function liquid droplet ejection head 51, the sealing member 124 becomes closely adhered to follow the nozzle surface 58, whereby the nozzle surface 58 of the function liquid droplet ejection head 51 is surely sealed. In addition, when the slightly inclined cap main body 114 is caused to depart from the function liquid droplet ejection head 51, the sealing member 124 leaves from one side relative to the nozzle surface 58, whereby the function liquid inside the head cap 113 is prevented from splashing.

The connecting coupling 135 is made up of: a spool piece 136 which is in communication with the suction port 139; and an L-shaped coupling 137 which is connected to the lower end portion of the spool piece 136, and is connected to the branch suction passage 162*a* for suction purpose through the L-shaped coupling 137. In other words, the cap main body 114 is connected to the suction pump 155 through the branch suction passage 162*a* for suction purpose and is further connected to the reusing tank 232 through the suction pump 155 (see FIG. 25).

The vent valve 131 is made up of: a sleeve 141 which is communicated with the atmosphere inlet port 138 and which penetrates through the cap base 121; a valve seat 142 which is formed to expand at the bottom of the sleeve 141; a valve body 143 which is made of rubber and is housed in the valve seat 142; a valve operation rod 146 which holds the valve body 143 through adhesion; and an engaging ring 145 which is engaged by screwing with the valve operation rod 146. The valve operation rod 146 is disposed in a slidable manner relative to a rod supporting member 147 which extends from the lower surface of the cap base 121, and is also urged in a valve closing direction (upward) by a valve spring 144 assembled into the rod supporting member 147.

The engaging ring 145 has engaged therewith the above-described hook 158. When the hook 158 is lowered by the air cylinder 156, the valve body 143 is lowered through the valve operation rod 146, whereby the vent valve 131 becomes an open state. On the other hand, when the hook 158 is moved upward by the valve spring 144, the valve body 143 is moved upward through the valve operation rod 146, whereby the vent valve 131 becomes a closed state. In other words, by lowering the vent valve 131 to open it at the final stage of the suction operation of the function liquid, the function liquid contained or impregnated in the function liquid absorbing material 122 can also be sucked.

The cleaning unit 111 having the above-described construction has been moved by the moving table 35 to a position crossing the moving locus in the Y-axis direction of the head unit 41. The head unit 41 moves by the Y-axis table 91 to a cleaning position which lies right above the cleaning unit 111. Then, by the operation of the lower-stage cylinder 162 in the elevating mechanism 161, the cap unit 112 is moved upward to the first position, and the twelve head caps 113 are urged from the lower side against the twelve function liquid droplet ejection heads 51. Each of the head caps 113 that has been urged against each of the function liquid droplet ejection heads 51 operates such that the cap main body 114 sinks slightly into the cap holder 115 against its own two springs 128, 128 so that the sealing member 124 uniformly adheres to the nozzle surface 58 of the function liquid droplet ejection head 51.

Subsequently, the suction pump 155 is driven and the suction gate valve 154 which is interposed in each of the branch suction passages 162 for suction purpose is opened. The liquid material is thus sucked from all of the ejection nozzles 59 of each of the function liquid droplet ejection heads 51 through each of the head caps 113. Then, right before the completion of suction operation, the vent valve 131 is opened and thereafter the suction gate valve 154 is closed to thereby complete the suction. Once the suction operation has been completed, the cap unit 112 is lowered to the lower end position. At the time of head safe-keeping in which the operation of the apparatus is stopped, or the like, the cap unit 112 is moved upward to the first position to thereby seal each of the function liquid droplet ejection heads 51 by each of the head caps 113. Capping is thus performed to keep the apparatus in the holding (safe-keeping) state.

The wiping unit 181 is provided with the function of performing the wiping of the plurality of function liquid droplet ejection heads 51 and is made up of: a take-up unit 182 which is disposed in a state of being abutted to the common base 36; and a wipe-out unit 184. When the cleaning of the head unit 41 has been completed, the wiping unit 181 delivers a wiping sheet from a delivery reel (not illustrated) toward the head unit 41 which is stopped right above the cleaning unit 111. The wiping unit 181 also sprays the cleaning liquid by a cleaning liquid spray head (not illustrated) and, while moving in the X-axis direction as a whole by the moving table 35, the nozzle surface 58 of each of the function liquid droplet ejection heads 51 is wiped out by using a wiping roller (not illustrated).

Then, a description will now be made about the flushing unit 191. The flushing unit 191 is disposed on a box of the X-axis flexible cable tray and is made up of: a slide base which is disposed on a box of an X-axis flexible cable tray and is fixed to the X-axis flexible cable tray; an elongated plate-shaped slider which is disposed so as to be movable back and forth on the slide base; a pair of flushing boxes 253, 253 which are fixed to both ends of the slider; and a pair of function liquid absorbing materials 254, 254 which are laid inside each of the flushing boxes 253. In the flushing unit 191 having the above-described arrangement, once the flushing unit 191 moves forward (or backward) together with the Θ table 84, each of the function liquid droplet ejection heads 51 performs the flushing operations sequentially at the time when the head unit 41 passes right above the right-side (left-side) flushing box (not illustrated). The head unit 41 then transfers to an ordinary liquid droplet ejection operation.

The flushing is performed in the following manner. Namely, the head unit 41 that must be subjected to the flushing operation as a result of stopping of the liquid ejection for a considerable period off time, is moved to the position right above the cap unit 112 and flushing is performed from each of the function liquid droplet ejection heads 51 toward each of the head caps 113. In this case, the flushing is performed at the second position in which a small clearance is generated or secured between the sealing member 124 of the head cap 113 and the nozzle surface 58 of the function liquid droplet ejection head 51. The function liquid that has been sprayed by flushing is absorbed by the function liquid absorbing material 122 disposed inside the head cap 113 and also is sucked by the suction pump 155 through the suction port 139 provided in the head cap 113.

When a new head unit 41 is introduced into the function liquid droplet ejection apparatus, the in-head flow passages of the function liquid droplet ejection head 51 are empty. Therefore, it becomes necessary to fill the in-head flow passages with the function liquid before starting the liquid droplet ejection work. In this case, since the supply of the function liquid is performed at a small water head, suction becomes necessary to fill the in-head flow passages with the function liquid. Therefore, in filling the function liquid, the head unit 41 is moved to the cleaning position, and the cap unit 112 is lifted to the first position. Each of the head caps 113 is caused to be adhered to the nozzle surface 58 of each of the function liquid droplet ejection heads 51. The function liquid inside the liquid supply pump 204 is filled into the in-head flow passage of each of the function liquid droplet ejection heads 51 by means of that suction force from the suction pump 155 which is caused to operate through each of the head caps 113.

When the suction is performed by the head caps 113, the flow velocity of the function liquid inside the in-flow passages lowers to thereby result in the occurrence of poor ejection of the liquid droplet due to the influence of air bubbles remaining in the in-head flow passages. In order to prevent such an occurrence, a supply gate valve 151 is interposed in each of branch supply passages 161*a* and a liquid sensor 152 is disposed in each of the branch supply passages 162*a* for suction purpose. When the function liquid is sucked down to the head caps 113 after starting the liquid filling, this liquid sensor 152 detects the fact and temporarily closes the gate valve 151 for supply purpose while continuing the suction by the head caps 113, to thereby smoothly perform the flow of the function liquid.

The liquid droplet ejection apparatus as described above is applicable not only to the apparatus for manufacturing an organic EL device as described in this embodiment, but also to the apparatuses for manufacturing a color filter, an LCD device, a PDP device, an electron emission device (FED device, SED device), or the like. Therefore, a description will now be made about the structure or construction of these objects of manufacturing, as well as the methods of manufacturing such objects by using the liquid droplet ejection apparatus 1 (function liquid droplet ejection head 51) of this embodiment.

Figure 26:
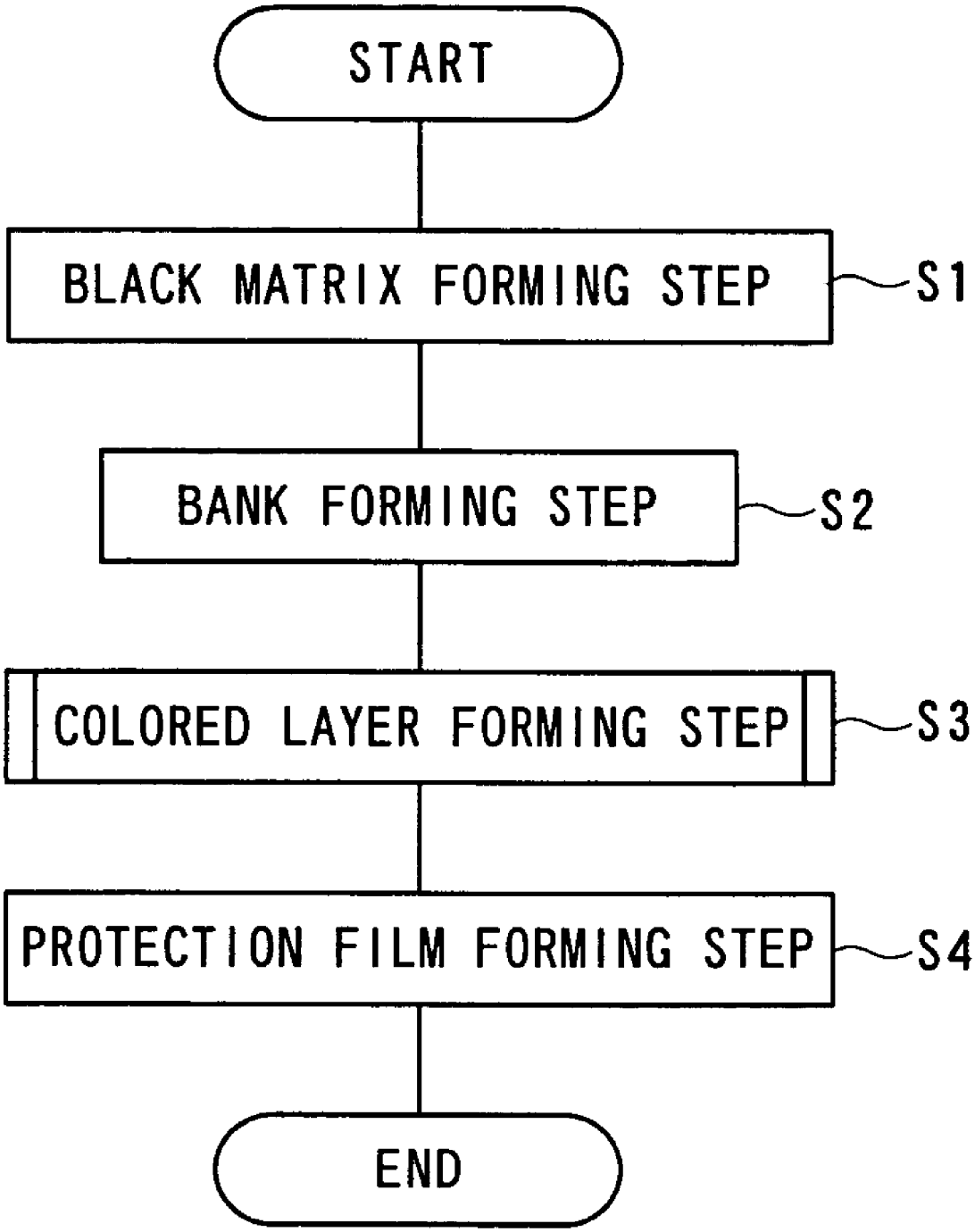
FIG. 26 is a flow chart showing the process of manufacturing the color filter.

First, a description will be made about the method of manufacturing a color filter which is to be built in an LCD device, an organic EL device, or the like. FIG. 26 is a flow chart showing the steps of manufacturing a color filter, and FIGS. 27A through 27E are schematic sectional views showing a color filter 500 (filter substrate 500A) according to this embodiment as shown in the order of manufacturing steps.

Figure 27A:
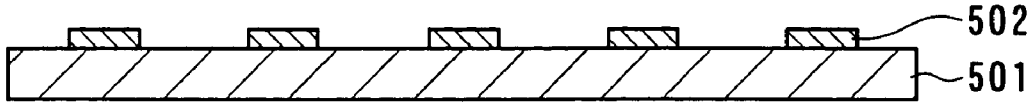
FIGS. 27A through 27E are schematic sectional views of the color filter as shown in the order of manufacturing steps.

First, at a black matrix forming step (S1), as shown in FIG. 27A, a black matrix 502 is formed on a substrate (W) 501. The black matrix 502 is formed of a laminated body of metallic chrome and chrome oxide, a resin black, or the like. In order to form the black matrix 502 made of a metallic thin film, a sputtering method, a vapor deposition method, or the like, may be used. In addition, in forming the black matrix made of a resin thin film, or the like, a gravure printing method, a photo-resist method, a thermal transfer printing method, or the like, may be used.

Figure 27B:
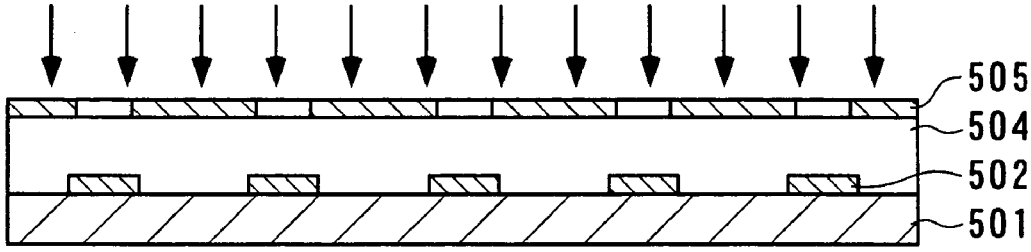

Next, at a bank forming step (S2), a bank 503 is formed in a state of being superimposed on the black matrix 502. Namely, as shown in FIG. 27B, a resist layer 504 which is made of a negative type of transparent photosensitive resin is formed so as to cover the substrate 501 and the black matrix 502. In a state in which the upper surface of the resist layer 504 is coated with a mask film 505 formed in a matrix pattern shape, an exposure processing is performed.

Figure 27C:
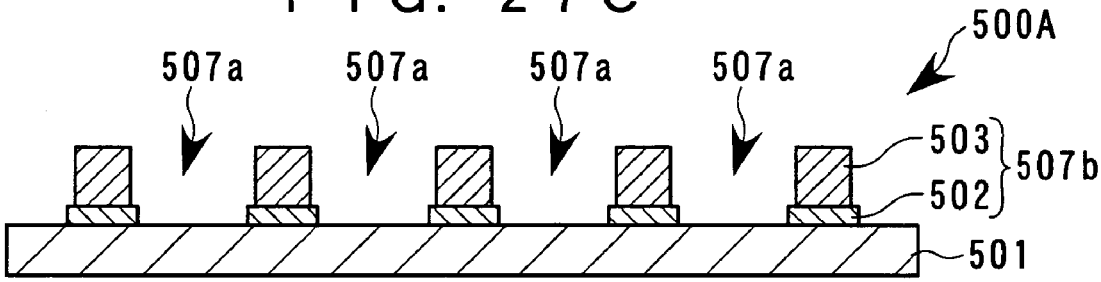

As shown in FIG. 27C, the non-exposed portion of the resist layer 504 is subjected to etching processing to perform patterning of the resist film 504, whereby a bank 503 is formed. In case the black matrix is formed by a resin black, it becomes possible to commonly use the black matrix and the bank.

The bank 503 and the black matrix 502 thereunder form a partition wall part 507*b* for partitioning each of the pixel regions 507*a* and, at the subsequent colored layer forming step, define the regions of hitting (or target regions) of the function liquid droplets when the colored layers (film forming portions) 508R, 508B, 508G are formed by the function liquid droplet ejection heads 10.

By passing through the above-described black matrix forming step and the bank forming step, the above-described filter substrate 500A is obtained.

In this embodiment, as the material for the bank 503, there is used a resin material whose coated film surface becomes liquid repellent (repellent against water). Since the surface of the substrate (glass substrate) 501 has a liquid affinity (affinity to water), there can be attained an improved accuracy in position of hitting of the liquid droplet on each of the pixel regions 507*a* which are enclosed by the bank 503 (partition wall part 507*b*).

Figure 27D:
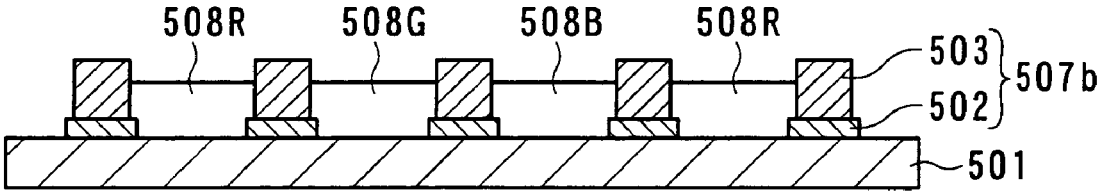

At the subsequent colored layer forming step (S3), as shown in FIG. 27D, the function liquid droplet is ejected by the function liquid droplet ejection head 51 so as to hit or reach each of the pixel regions 507*a* as enclosed by the partition wall part 507*b*. In this case, too, like in the case of the above-described organic EL device 600, the function liquids (filter materials) of three colors of red, green, and blue are introduced by using the function liquid droplet ejection heads 51 to thereby perform the ejection of the function liquid droplets. As the arrangement pattern of three colors of red, green, and blue, there can be listed a stripe arrangement, a mosaic arrangement, a delta arrangement, or the like.

Figure 27E:
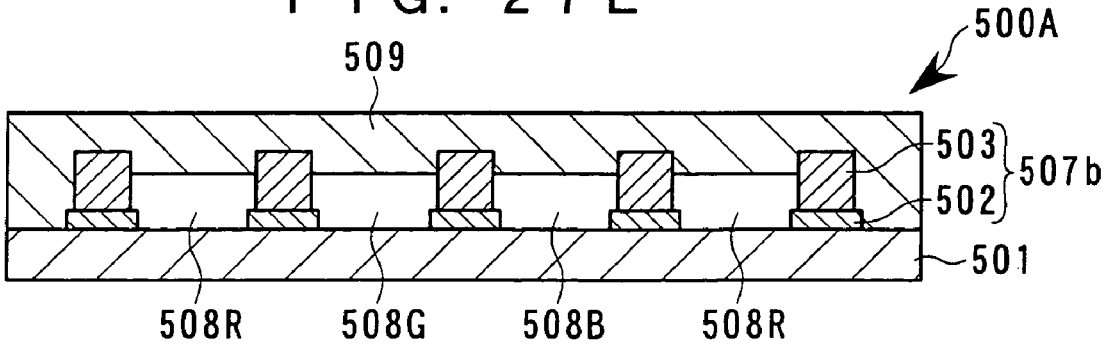

Thereafter, the function liquid is fixed by going through the drying processing (processing of heating, or the like) to thereby form the colored layers 508R, 508G, 508B of three colors. Once the colored layers 508R, 508G, 508B of three colors have been formed, the step proceeds to a protection film forming step (S4). As shown in FIG. 27E, there is formed a protection film 509 so as to cover the upper surface of the partition wall part 507*b* and the colored layers 508R, 508G, 508B.

In other words, after the protection coating liquid has been ejected over that entire surface of the substrate 501 on which the colored layers 508R, 508G, 508B have been formed, the protection film 509 is formed through the drying processing.

After having formed the protection film 509, the substrate 501 is cut into respective effective pixel regions to thereby obtain the color filter 500.

Figure 28:
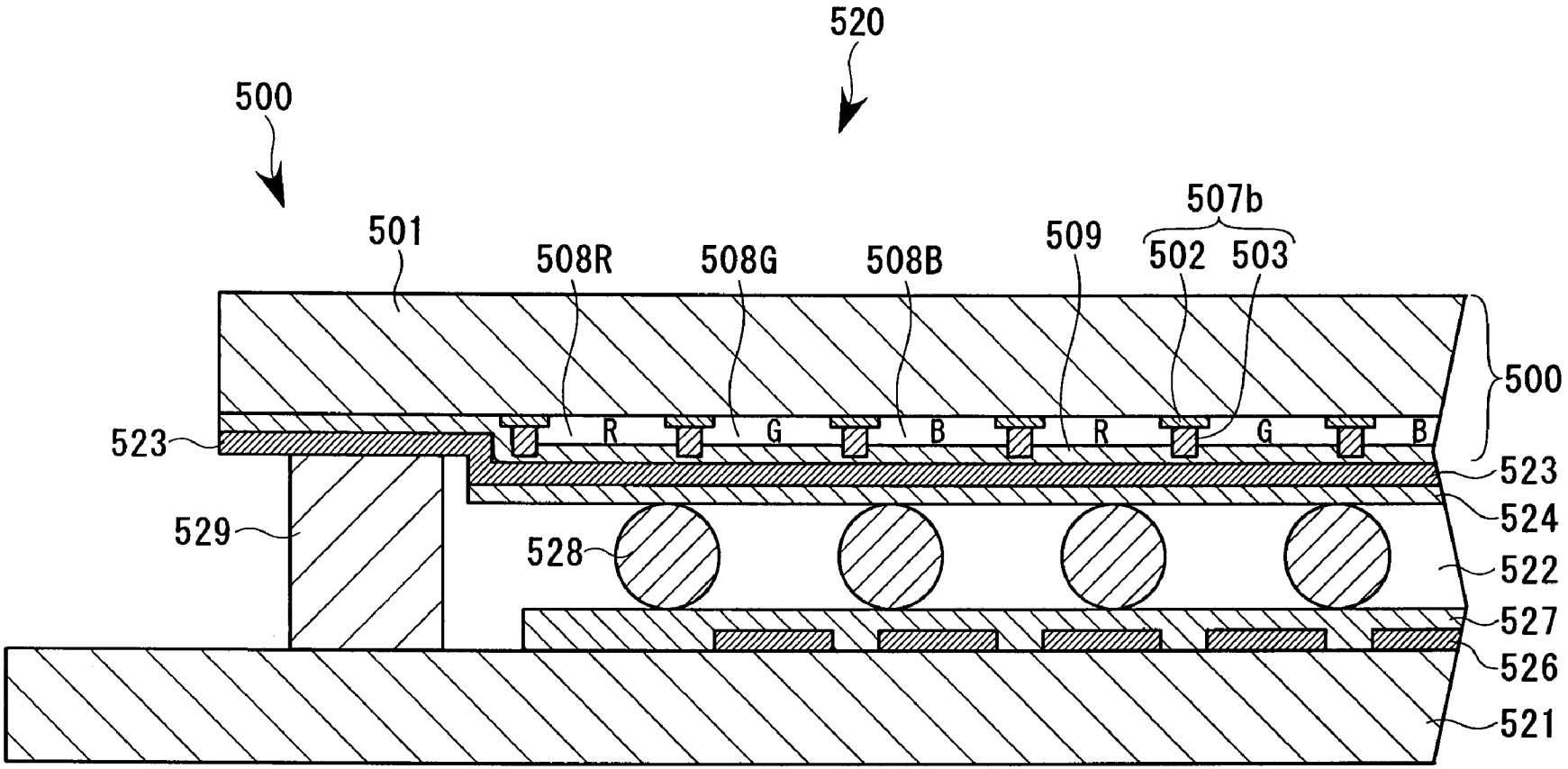
FIG. 28 is a sectional view of an important portion showing a liquid crystal device using a color filter to which this invention is applied.

FIG. 28 is a sectional view of an important portion showing a general arrangement of a passive matrix type of liquid crystal device (liquid crystal device) as an example of the liquid crystal display device using the above-described color filter 500. By mounting on this liquid crystal device 520 the additional elements such as a liquid crystal driving integrated circuit (IC), back light, supporting member, or the like, the translucent type of liquid crystal display device is obtained as a final product. Since the color filter 500 has the same arrangement as that shown in FIGS. 27A through 27E, the same reference numerals are affixed to the corresponding elements to thereby omit the description thereof.

This liquid crystal device 520 is substantially made up of a color filter 500, an opposite electrode 521 which is made of a glass substrate, or the like, and a liquid crystal layer 522 which is made of a super twisted nematic (STN) liquid crystal composition of matter interposed therebetween. The color filter 500 is disposed on an upper side in the figure (on the side of the viewer).

Though not illustrated, a polarizer is respectively disposed on outside surfaces of the opposite electrode 521 and the color filter 500 (on the side surface which is opposite to the liquid crystal layer 522). On that outside surface of the polarizer which is located on the side of the opposite electrode 521, there is disposed a back light.

On the protection film 509 (on the side of the liquid crystal layer) of the color filter 500, there are formed a plurality of first electrodes 523 of a shape elongated in the left and right direction at a distance from one another. A first alignment film (layer) 524 is formed so as to cover those surfaces of the first electrodes 523 which are opposite to the side of the color filter 500.

On the other hand, on that surface of the opposite electrode 521 which lies opposite to the color filter 500, there are formed a plurality of second electrodes 526 which are elongated in a direction crossing the first electrodes 523 at right angles. A second alignment layer 527 is formed so as to cover those surfaces of the second electrodes 526 which lie on the side of the liquid crystal layer 522. These first electrodes 523 and the second electrodes 526 are formed of an electrically conductive transparent material such as ITO, or the like.

The spacer 528 disposed inside the liquid crystal layer 522 is a material for holding the thickness of the liquid crystal layer 522 (cell gap) constant. The sealing material 529 serves the purpose of preventing the liquid crystal composition of matter inside the liquid crystal layer 522 from leaking outside. One end portion of the first electrode 523 is extended to the outside of the sealing material 529 as a leading wire 523*a*.

Those portions at which the first electrodes 523 and the second electrodes 526 cross each other form the pixels, and the colored layers 508R, 508G, 508B of the color filter 500 are arranged to be positioned in these portions to form the pixels.

In an ordinary manufacturing steps, the following take place. Namely, the color filter 500 is subjected to the patterning of the first electrodes 523 and the coating of the first alignment film 524, to thereby form the portions on the side of the color filter 500. Also, the opposite substrate 521 is subjected to the patterning of the second electrodes 526 and the coating of the second alignment film 527, to thereby form the portions on the side of the opposite electrode 521. Thereafter, the spacer 528 and the sealing material 529 are formed in the portion on the side of the opposite electrode 521. In this state the portion on the side of the color filter 500 is adhered together. Then, the liquid crystal to constitute the liquid crystal layer 522 is filled from the inlet port of the sealing material 529, and the inlet port is closed. Thereafter, both the polarizers and the back light is laminated together.

The liquid droplet ejection apparatus 1 of this embodiment can coat the spacer material (function liquid) which constitutes the above-described cell gap and can also uniformly coat the liquid crystal (function liquid) onto a region enclosed by the sealing material 529, prior to the adhering of the portion on the side of the color filter 500 to the portion of the opposite substrate 521. In addition, the printing of the sealing material 529 can also be made by the function liquid droplet ejection head 51. Still furthermore, the coating of the first and second alignment films 524, 527 by the function liquid droplet ejection head 51 is also possible.

Figure 29:
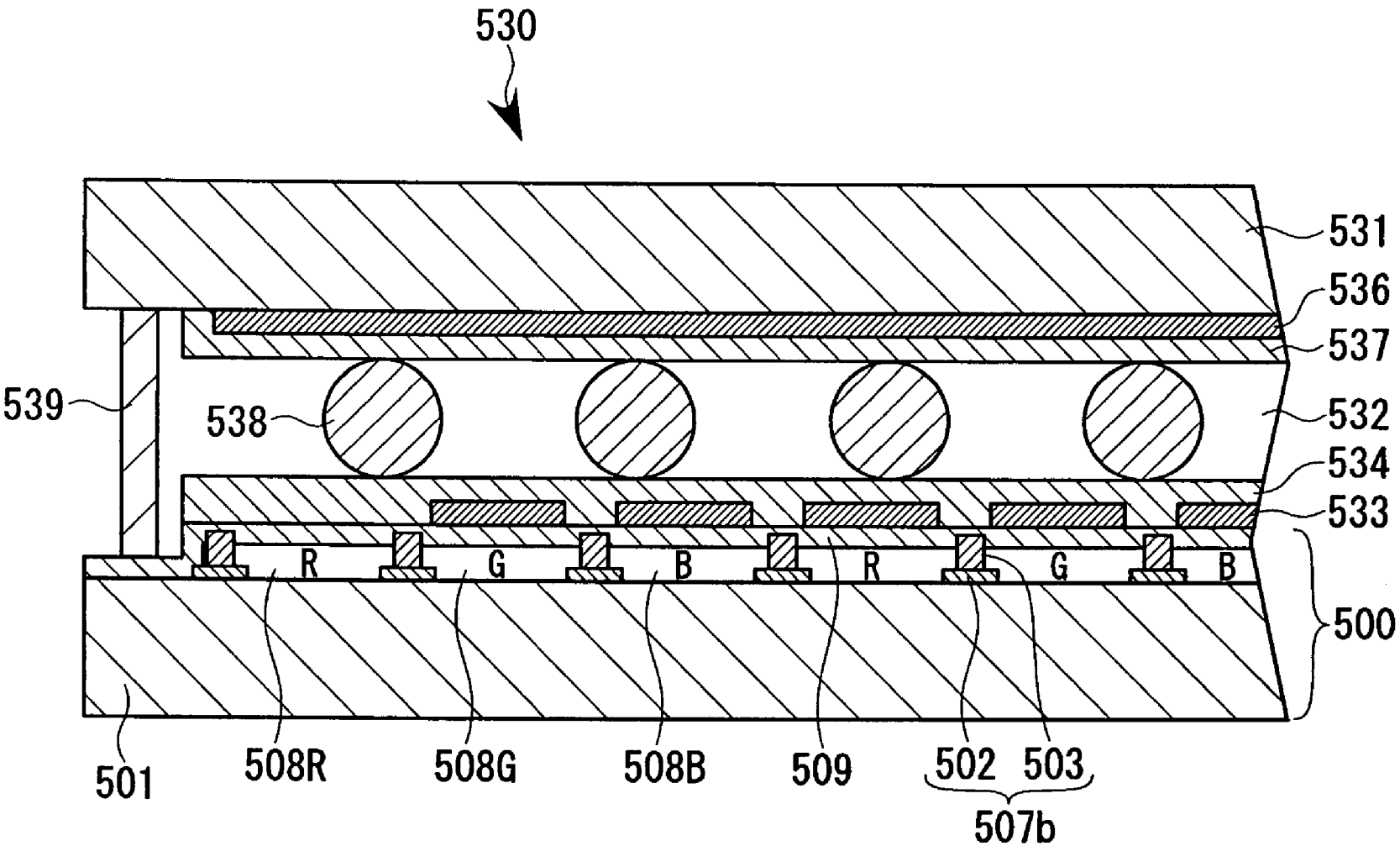
FIG. 29 is a sectional view of an important portion showing a second example of liquid crystal device using a color filter to which this invention is applied.

FIG. 29 is a sectional view showing an important portion of the second example of the crystal device using the color filter 500 manufactured according to this embodiment.

What this liquid crystal device 530 is largely different from the above-described liquid crystal device 520 is that the color filter 500 is disposed on the lower side as seen in the figure (on the side opposite to the viewer).

This liquid crystal device 530 is substantially made up by sandwiching the liquid crystal 532 which is made up of an STN device between the color filter 500 and the opposite substrate 531 made of a glass substrate, or the like. Though not illustrated, a polarizer, or the like is disposed on an outside surface of the opposite substrate 531 and the color filter 500, respectively.

On a protection film 509 (on the side of the liquid crystal layer 532) of the color filter 500, there are disposed a plurality of first electrodes 533 which are elongated in a direction perpendicular as seen in the figure at a given distance from one another. The first alignment film 534 is formed so as to cover those surfaces of the first electrodes 533 which lie on the side of the liquid crystal layer 532.

On that surface of the opposite substrate 531 which lies opposite to the color filter 500, there are formed a plurality of second electrodes 536 which are elongated in a direction crossing the first electrodes 533 at right angles. A second alignment film 537 is formed so as to cover those surfaces of the second electrodes 536 which lie on the side of the liquid crystal layer 532.

The liquid crystal layer 532 has disposed therein a spacer 538 which keeps the thickness of the liquid crystal layer 532 constant, and a sealing material 539 which prevents the liquid crystal composition of matter inside the liquid crystal layer 532 from leaking outside.

In the same manner as the above-described liquid crystal device 520, the portions at which the first electrodes 533 and the second electrodes 536 cross each other constitute the pixels, and it is so arranged that the colored layers 508R, 508G, 508B are positioned in the portions which constitute the pixels.

Figure 30:
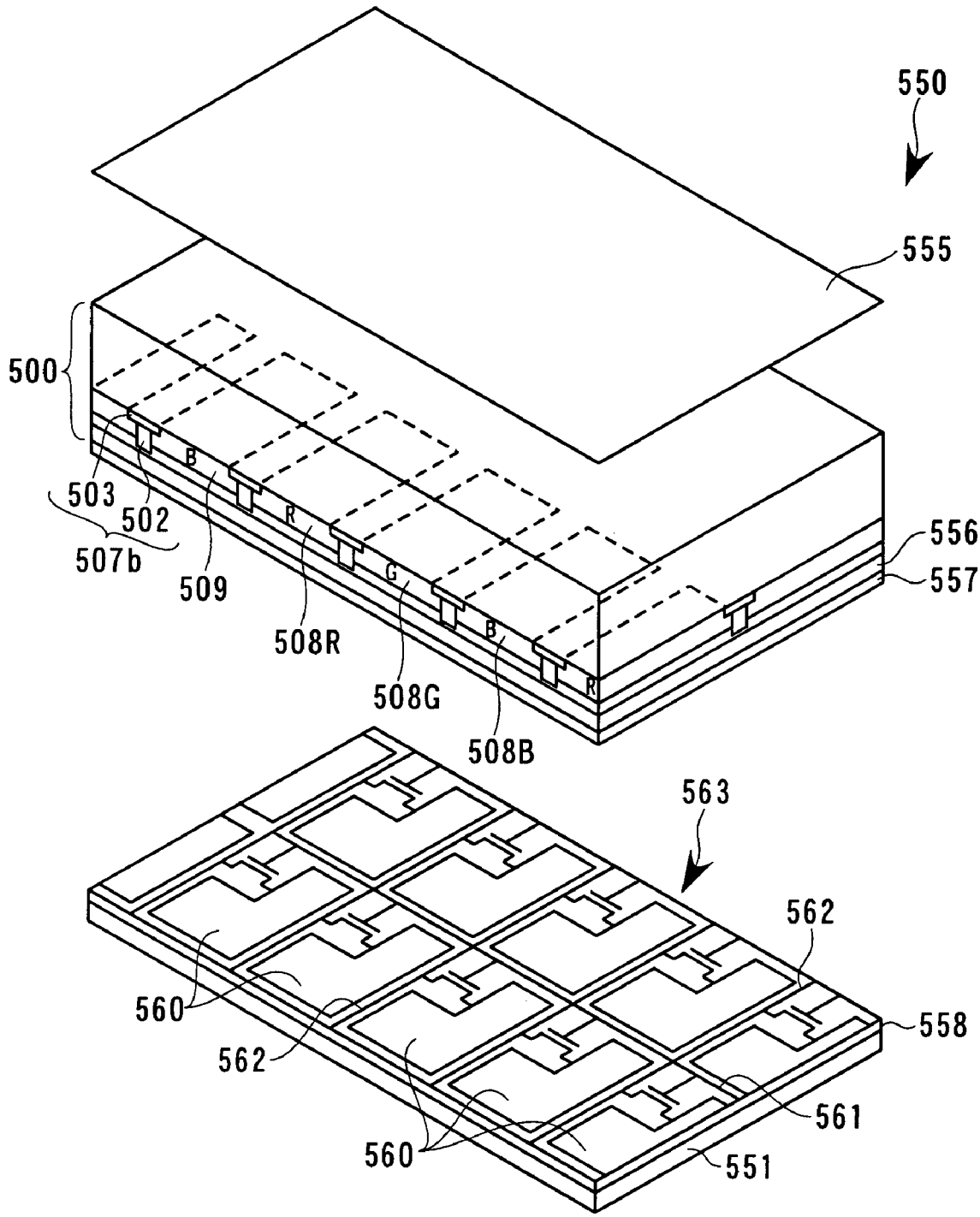
FIG. 30 is a sectional view of an important portion showing a third example of liquid crystal device using a color filter to which this invention is applied.

FIG. 30 is a third example of constituting a liquid crystal device using the color filter 500 to which this invention is applied and shows an exploded perspective view showing a general arrangement of a transmission type of thin film transistor (TFT) liquid crystal device.

This liquid crystal device 550 has disposed the color filter 500 on an upper side of the figure (on the side of the viewer).

This liquid crystal device 550 is generally made up of: a color filter 500; an opposite substrate 551 which is disposed so as to lie opposite to the color filter 500; a liquid crystal layer (not illustrated) which is interposed between the color filter 500 and the opposite substrate 551; a polarizer 555 which is disposed on an upper surface side of the color filter 500; and a polarizer (not illustrated) which is disposed on a lower surface side of the opposite substrate 551.

An electrode 556 for driving the liquid crystal is formed on the surface of the protection film 509 of the color filter 500. This electrode 556 is made of an electrically conductive transparent material such as ITO, or the like, and forms an overall electrode which covers the entire region in which the pixel electrodes 560 (to be described hereinafter) are to be formed. Further, in a state of covering that surface of this electrode 556 which lies opposite to the pixel electrodes 560, there is disposed an alignment film 557.

An insulation layer 558 is formed on that surface of the opposite substrate 551 which lies opposite to the color filter 500. On this insulation layer 558 are formed a scanning line 561 and a signal line 562 in a state in which they cross each other at right angles. Inside the regions enclosed by these scanning line 561 and the signal line 562, there are formed pixel electrodes 560. In the actual crystal liquid device, an alignment film (not illustrated) is disposed on the pixel electrodes 560.

Further, in each of the regions enclosed by the notched portion of the pixel electrode 560, the scanning line 561, and the signal line 562, there is built in a thin film transistor 563 which is provided with a source electrode, a drain electrode, a semiconductor, and a gate electrode. By means of charging the scanning line 561 and the signal line 562 with signals, the thin film transistor 563 is switched on and off to thereby control the energizing of the pixel electrodes 560.

The above-described liquid crystal device 520, 530, 550 is arranged to be of a transmission type, but a reflection type of liquid crystal device or a translucent reflection type of liquid crystal may also be employed by providing a reflection layer or a translucent reflection layer.

Figure 31:
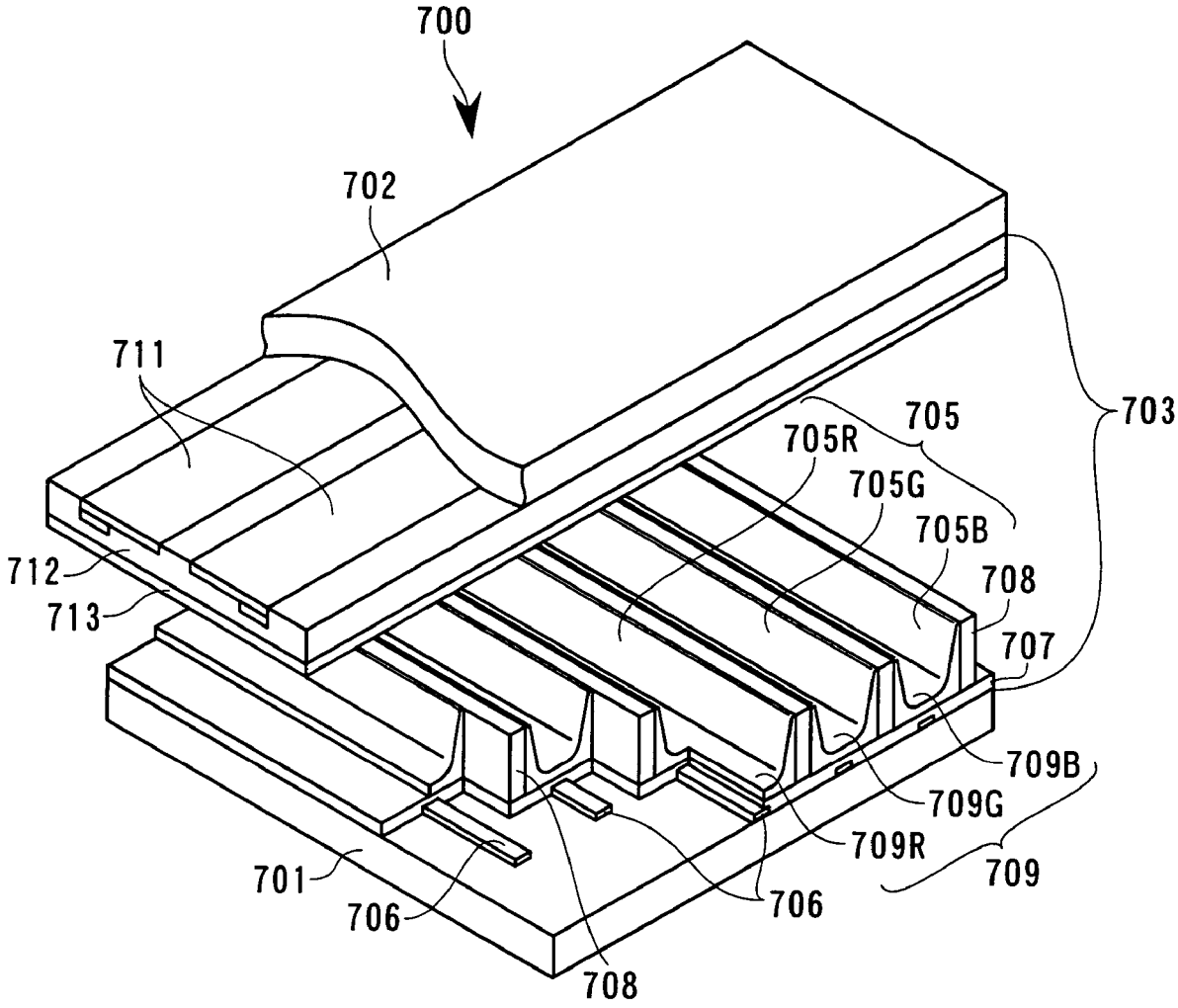
FIG. 31 is an exploded perspective view of an important portion of a display device in the form of a PDP device.

Then, FIG. 31 is a perspective view showing an important portion of a plasma type display device (PDP device, hereinafter simply referred to as a display device 700). In the figure, the display device 700 is illustrated in a partly cut-away state.

This display device 700 is substantially constituted by a first substrate 701 and a second substrate 702 which are disposed to face each other, as well as a discharge display part 703 which is formed between the above two. The discharge display part 703 is made up of a plurality of discharge chambers 705. Out of these plurality of discharge chambers 705, a red-color (R) discharge chamber 705R, a green-color (G) discharge chamber 705G, and a blue-color (B) discharge chamber 705B together constitute one pixel as a set.

On an upper surface of the first substrate 701 there are formed address electrodes 706 in a shape of stripe at a given distance from one another. A dielectric layer 707 is formed to cover the upper surfaces of the address electrodes 706 and the first substrate 701. On top of the dielectric layer 707, there are vertically disposed partition walls 708 which are positioned between each of the address electrodes 706 and which are elongated along each of the address electrodes 706. These partition walls 708 include those, as illustrated, which are elongated on widthwise both sides of each of the address electrodes 706 and those which are elongated (not illustrated) in the direction at right angles to the address electrodes 706.

The regions partitioned by the partition walls 708 constitute the discharge chambers 705. Inside each of the discharge chambers 705 is disposed a fluoresce body 709 which discharges any one of red (R), green (G) and blue (B) colors. At the bottom of the red-color discharge chamber 705R is disposed a red-color fluorescent material 709R, at the bottom of the green-color discharge chamber 705G is disposed a green-color fluorescent material 709G, and at the bottom of the blue-color discharge chamber 705B is disposed a blue-color fluorescent material 709B, respectively.

On the lower side surface (as seen in the figure) of the second substrate 702, there are formed a plurality of display electrodes 711 so as to be elongated in a direction at right angles to the address electrodes 706. A dielectric layer 712 and a protection film 713 made of MgO, or the like, are formed to cover them.

The first electrode 701 and the second electrode 702 are adhered together to face each other such that the address electrodes 706 and the display electrodes 711 cross each other at right angles. The address electrodes 706 and the display electrodes 711 are connected to an AC power source (not illustrated).

In the above arrangement, when each of the electrodes 706, 711 is electrically charged, the fluorescent materials 709 get excited to emit light at the discharge display part 703, whereby color display becomes possible.

In this embodiment, the address electrodes 706, the display electrodes 711, and the fluorescent bodies 709 can be formed by using the liquid droplet ejection apparatus 1 shown in FIG. 12. A description will now be made, by way of example, about the steps of forming the address electrodes 706 on the first substrate 701.

In this case, the following steps are performed in a state in which the first substrate 701 is mounted on the X-axis table 82 of the liquid droplet ejection apparatus 1.

First, by means of the function liquid droplet ejection head 10, a liquid material (function liquid) containing therein the electrically conductive wire forming material is caused to hit (or to be fired at) the address electrode forming region as the function liquid droplet. This liquid material is obtained by dispersing the electrically conductive fine particles of metal, or the like, into a dispersion medium. As the dispersion medium, there may be used: metallic fine particles containing therein gold, silver, copper, palladium, nickel, or the like; electrically conductive polymer; or the like.

Once all of the address electrode regions, which are the objects of filling, have been filled with the liquid material, the ejected liquid material is subjected to drying processing to thereby evaporate the dispersion medium contained in the liquid material, whereby the address electrodes 706 are formed.

In the above description, a description was made about the forming of address electrodes 706 as an example. The display electrodes 711 and the fluorescent bodies 709 can also be formed by passing through the above-described steps.

In the case of forming the display electrodes 711, a liquid material (function liquid) containing therein an electrically conductive film forming material is caused to reach the display electrode forming region as a function liquid droplet in the same manner as in the case of the address electrodes 706.

In the case of forming the fluorescent bodies 709, a liquid material (function liquid) containing therein a fluorescent material corresponding to each of the colors (R, G, B) is ejected from the function liquid droplet ejection head 51 as the liquid droplets so as to reach the discharge chamber 705 of corresponding colors.

Figure 32:
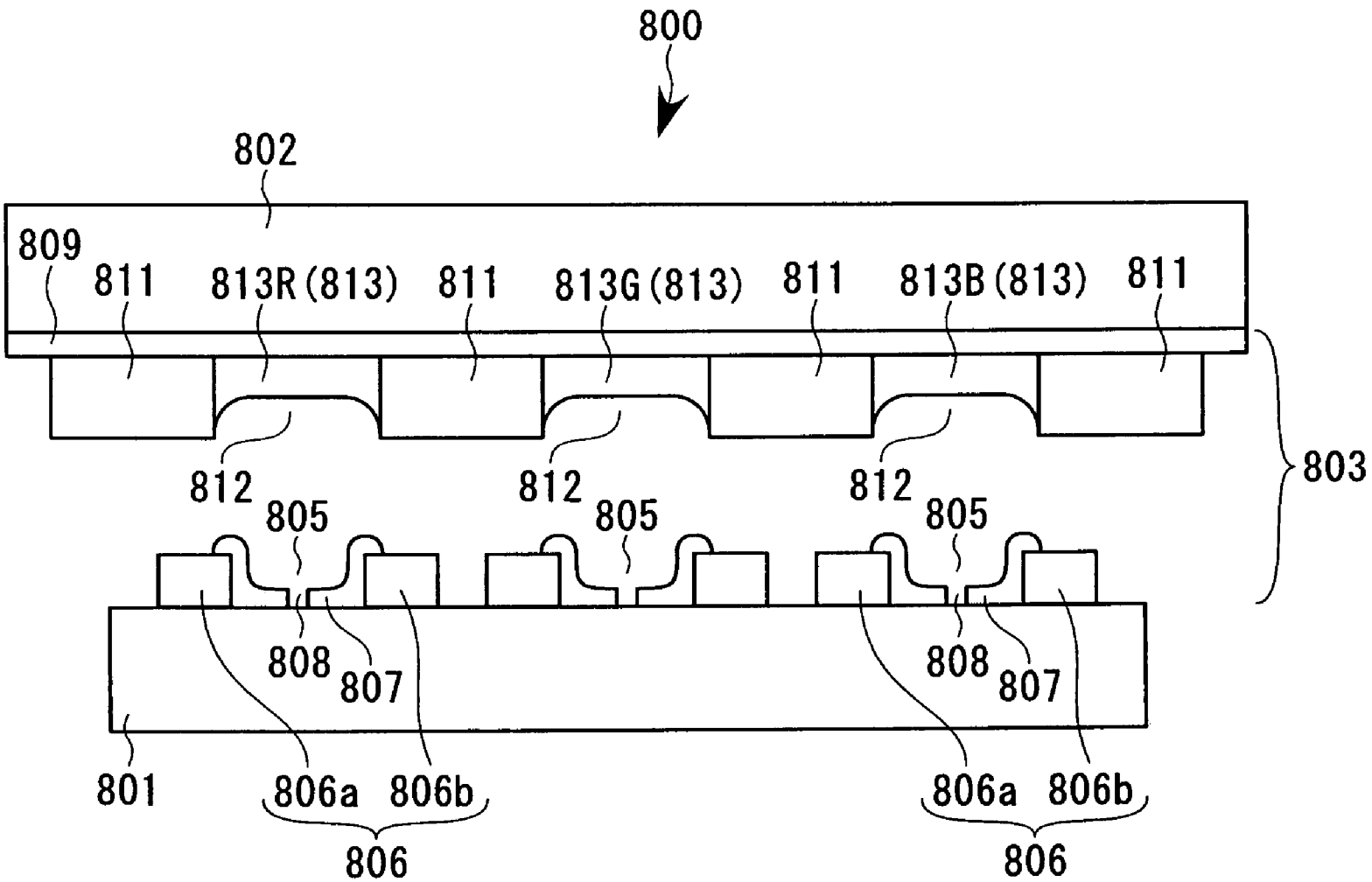
FIG. 32 is a sectional view of an important portion of a display device in the form of a PDP device.

FIG. 32 is a sectional view of an important portion of an electron emission device (FED device, hereinafter referred to as a display device 800), partly shown in section.

This display device 800 is made up of: a first substrate 801 and a second substrate 802 which are disposed so as to lie opposite to each other; and an electron emission display part 803 which is formed between the above two. The field emission display part 803 is made of a plurality of electron emission parts 805 which are disposed in matrix.

On an upper surface of the first substrate 801, there are formed first element electrodes 806*a* and second element electrodes 806*b* in a manner to cross each other at right angles. In addition, in each of the portions partitioned by the first electrode element electrodes 806*a* and the second element electrodes 806*b*, there is formed an element film 807 having a gap 808 formed therebetween. Namely, the first element electrodes 806*a*, the second element electrodes 806*b*, and the element films 807 constitute a plurality of electron emission parts 805. The element film 807 is constituted, e.g., by palladium oxide (PdO), or the like. The gap 808 is formed (prepared) by the work called "forming", or the like, after the element film 807 has been formed (prepared).

On a lower surface of the second substrate 802, there is formed an anode electrode 809 which lies opposite to the cathode electrode 806. On a lower surface of the anode electrode 809, there is formed a lattice-shaped bank part 811. In each of the downward opening parts enclosed by this bank part 811, there is disposed a fluorescent body 813 so as to correspond to the electron emission part 805. The fluorescent part 813 is to emit any one of colors of red, green, and blue. Each of the opening parts 812 has disposed therein a red-color fluorescent body 813R, a green-color fluorescent body 813G, and a blue-color fluorescent body 813B in a predetermined pattern.

The first substrate 801 and the second substrate 802 thus constituted are adhered together while leaving a very minute gap therebetween. In this display device 800, the electrons to be emitted from the cathode in the form of the first element electrode 806*a* or the second element electrode 806*b* through the element film (gap 808) 807 are directed to the fluorescent bodies 813 which are formed on the anode in the form of the anode electrode 809 to thereby emit light through excitation. Color display thus becomes possible.

In this case, too, like in the other embodiments, the first element electrode 806*a*, the second element electrode 806*b*, and the anode electrode 809 can be formed by using the liquid droplet ejection apparatus 1. Each of the fluorescent bodies 813R, 813G, 813B of respective colors can also be formed by using the liquid droplet ejection apparatus 1.

The liquid droplet ejection apparatus as described above can be applied to the method of manufacturing an electrophoretic display device, or the like, aside from the devices such as an organic EL device, or the like, as described in the above-described embodiments.

In the method of manufacturing the electrophretic display device, an electrophoretic material of each color is introduced into a plurality of function liquid droplet ejection heads 51. The plurality of function liquid droplet ejection heads 51 are subjected to main scanning and sub-scanning to thereby selectively eject the electrophoretic material. A fluorescent body is thus formed in each of the multiplicity of recessed portions on the electrodes. The electrophoretic bodies made of electrically charged particles and pigments shall preferably be sealed in microcapsules.

On the other hand, the liquid droplet ejection apparatus 1 of this embodiment can also be applied to the method of forming a spacer, the method of forming metallic wiring, the method of forming a lens, the method of forming a resist, and a method of forming a light diffusion body, or the like.

The method of forming a spacer is to form a multiplicity of particulate spacers which constitute minute cell gap between the two substrates. A function liquid to be obtained by dispersing in the liquid the particulate material which constitutes the spacers is introduced into a plurality of function liquid droplet ejection heads 51, which are then subjected to the main scanning and the sub-scanning to thereby selectively eject the function liquid so as to form the spacers on at least one of the substrates. For example, this method is useful in constituting the cell gap between the two substrates in the above-described liquid crystal display device or in the electrophoretic display device. The method can further be applied to the art of manufacturing semiconductors which require this kind of minute gap.

In the method of manufacturing metallic wiring, a liquid metallic wire material is introduced into a plurality of function liquid droplet ejection heads 51, which are then subjected to the main canning and sub-scanning while selectively ejecting the liquid metallic material. A metallic wiring is thus formed on the substrate. For example, this method can be applied to the metallic wiring to connect the driver and each of the electrodes in the above-described liquid crystal display device and to the metallic wiring to connect the TFT, or the like, and each of the electrodes in the above-described organic EL device, to thereby manufacture these devices. In addition, this method can also be applied to the general art of manufacturing semiconductors, aside from this kind of flat display panels.

In the method of forming a lens, the lens material is introduced into the plurality of function liquid droplet ejection head 51. A plurality of liquid droplet ejection heads 51 are then subjected to main scanning and sub-scanning to selectively eject the lens material. A multiplicity of micro-lenses are formed on the transparent substrate. This method can be applied to the art of manufacturing a device for beam focusing in the above-described FED device. It is further applicable to the art of manufacturing various kinds of optical devices.

In the method of manufacturing a lens, a translucent coating material is introduced into the plurality of function liquid droplet ejection heads 51, which are then subjected to the main canning and sub-scanning to thereby selectively eject the coating material. A coating film is thus formed on the surface of the lens.

In the method of forming a resist, a resist material is introduced into a plurality of function liquid droplet ejection heads 51, which are then subjected to main scanning and sub-scanning while selectively ejecting the resist material. A photo-resist of an arbitrary shape is thus formed on the substrate. For example, this method can be applied to the forming of banks in the above-described various display devices, as well as to the coating of photo-resists in the lithographic method which constitutes the main body of the semiconductor manufacturing art.

In the light diffusion body forming method, a light diffusion material is introduced into a plurality of function liquid droplet ejection heads 51, which are then subjected to the main scanning and sub-scanning while electively ejecting the function liquid droplet. A multiplicity of light diffusion bodies are thus formed on the substrate. It is needless to say that this method is applicable to the various kinds of optical devices.

According to the above-described head cap of this invention, the function liquid absorbing material can be easily replaced without impairing the original function such as sealing, or the like. The function liquid droplet ejection heads can therefore be adequately maintained.

In addition, according to the function liquid droplet ejection apparatus of this invention, the function liquid droplet ejection heads can be well maintained. Therefore, the reliability thereof can be enhanced.

According to the various methods of manufacturing of this invention such as the method of manufacturing the liquid crystal display device, the method of manufacturing the organic EL device, or the like, the reliability of the method of manufacturing can be enhanced through the liquid droplet ejection apparatus.

The entire disclosure of Japanese Patent Application Nos. 2002-245476 filed Aug. 26, 2002 and 2003-190815 filed Jul. 3, 2003 are incorporated by reference.

What is claimed is:

1. A head cap comprising:

a cap base;

an absorbing material housing part which is formed on a surface of said cap base;

a function liquid absorbing material which is disposed inside said absorbing material housing part;

an absorbing material urging member which urges the function liquid absorbing material;

a sealing member which is formed so as to come into intimate contact with a nozzle surface of a function liquid droplet ejection head; and a seal fixing member which fixes said sealing member to said cap base;

wherein said sealing member is fixed to said cap base in a state in which said absorbing material urging member is urged.

2. The head cap according to claim 1, wherein said absorbing material housing part comprises a loop-shaped peripheral portion which defines a recessed groove and which projects beyond said cap base, said recessed groove being filled with the function liquid absorbing material, and wherein a peripheral portion of said absorbing material urging member is seated on said loop-shaped peripheral portion.

3. The head cap according to claim 1, wherein said absorbing material urging member is formed into a small thickness and comprises: a frame-shaped part which urges the peripheral portion of said function liquid absorbing member; and a lattice-shaped part which urges an intermediate portion thereof.

4. The head cap according to claim 3, wherein said frame-shaped part and said lattice-shaped part are formed integral with each other.

5. The head cap according to claim 1, wherein said absorbing material urging member is formed of a stainless steel.

6. The head cap according to claim 1, wherein said sealing member is integrally formed of: a loop-shaped projecting part which comes into intimate contact with said nozzle surface; a loop-shaped urging part which urges said absorbing material urging member; and a loop-shaped fixing part which is fixed to said cap base, and wherein said loop-shaped urging part is formed on a back surface side of said loop-shaped projecting part.

7. The head cap according to claim 6, wherein said seal fixing member is formed into a loop shape and is screwed to said cap base in a state in which said loop-shaped fixing part of said sealing member is urged against said cap base.

8. The head cap according to claim 1, further comprising: a cap holder which slidably supports said cap base in a direction of close adhesion; and a spring which urges said cap base, with said cap holder serving as a receiver, wherein said cap holder has formed therein a restricting projection part which restricts a position of said cap base in a slightly inclined state relative to said cap base against said spring.

9. A liquid droplet ejection apparatus comprising:

a head cap as set forth in claim 1;

the function liquid droplet ejection head;

an approaching and departing mechanism for relatively moving said head cap toward, and away from, said function liquid droplet ejection head; and a suction mechanism for sucking a function liquid from said function liquid droplet ejection head through said head cap which is connected to, and adhered to, said head cap.

* * * * *